US006575625B2

(12) United States Patent
Cappel et al.

(10) Patent No.: US 6,575,625 B2
(45) Date of Patent: Jun. 10, 2003

(54) RECLOSABLE BAGS HAVING A REMOVABLE MEMBER ENCAPSULATING A SLIDER

(75) Inventors: Craig E. Cappel, Pittsford, NY (US); Michael W. McManus, East Rochester, NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/917,389

(22) Filed: Jul. 27, 2001

(65) Prior Publication Data

US 2001/0043762 A1 Nov. 22, 2001

Related U.S. Application Data

(62) Division of application No. 09/309,465, filed on May 11, 1999, now Pat. No. 6,286,999.

(51) Int. Cl.[7] ..... B65D 33/14

(52) U.S. Cl. ..... 383/5; 24/397; 24/587.1; 383/64

(58) Field of Search ..... 383/5, 64, 65, 383/61, 63, 78; 24/400, 429, 397, 398, 587.1; 493/213, 214

(56) References Cited

U.S. PATENT DOCUMENTS

| | | | |
|---|---|---|---|
| 764,653 | A | 7/1904 | Witte |
| 880,909 | A | 3/1908 | Oneal |
| 1,992,152 | A | 2/1935 | Yeates |
| 2,064,432 | A | 12/1936 | Keidel |
| 2,107,216 | A | 2/1938 | Rogers |
| 2,111,079 | A | 3/1938 | Spear et al. |
| 2,161,561 | A | 6/1939 | Dalton |
| 2,394,335 | A | 2/1946 | Shapiro |

(List continued on next page.)

FOREIGN PATENT DOCUMENTS

| | | |
|---|---|---|
| AU | 24938 | 10/1938 |
| CA | 698325 | 11/1964 |
| CA | 844416 | 6/1970 |
| CH | 335602 | 1/1959 |
| DE | 1 211 834 | 3/1966 |
| EP | 0 109 793 | 5/1984 |
| EP | 0 109 793 | 3/1987 |
| EP | 0 276 554 | 8/1988 |

(List continued on next page.)

OTHER PUBLICATIONS

PCT International Search Report; PCT US/99/14980, dated Feb. 8, 2000.

*Primary Examiner*—Robin Hylton
(74) *Attorney, Agent, or Firm*—Jenkens & Gilchrist

(57) ABSTRACT

A plastic bag comprises opposing body panels fixedly connected to each other along a pair of sides and a bottom bridging the pair of sides. A reclosable zipper extending along a mouth portion formed opposite the sealed bottom of the plastic bag. The zipper is preferably free of graspable upper pull flanges in order to best accommodate a slider and inhibit operation of the zipper without the slider. The slider is mounted to the zipper for movement between a closed position and an open position. The zipper is closed while the slider is in the closed position. The zipper is opened in response to movement of the slider to the open position. To inhibit tampering with the contents of the bag, the bag includes a tamper-evident feature. In one set of embodiments, the tamper-evident feature initially maintains the slider in the closed position and allows the slider to move away from the closed position toward the open position in response to removing or breaking the tamper-evident feature. In another set of embodiments, the tamper-evident feature initially maintains a mouth portion of the plastic bag in a folded position and allows the mouth portion to be unfolded in response to removing or breaking the tamper-evident feature.

31 Claims, 20 Drawing Sheets

U.S. PATENT DOCUMENTS

| | | | |
|---|---|---|---|
| 2,506,311 | A | 5/1950 | Moore |
| 2,514,750 | A | 6/1950 | Dobb et al. |
| 2,560,535 | A | 7/1951 | Allen |
| 2,724,543 | A | 11/1955 | Bauer |
| 2,848,031 | A | 8/1958 | Svec et al. |
| 2,898,027 | A | 8/1959 | Scholle |
| 2,978,769 | A | 4/1961 | Harrah |
| 2,994,469 | A | 8/1961 | Troup et al. |
| 3,054,434 | A | 9/1962 | Ausnit et al. |
| 3,104,798 | A | 9/1963 | Stone |
| 3,172,443 | A | 3/1965 | Ausnit |
| 3,181,583 | A | 5/1965 | Lingenfelter |
| 3,198,228 | A | 8/1965 | Naito |
| 3,226,787 | A | 1/1966 | Ausnit |
| 3,256,981 | A | 6/1966 | Kurtz |
| 3,262,634 | A | 7/1966 | Goodwin |
| 3,282,493 | A | 11/1966 | Kamins et al. |
| 3,313,471 | A | 4/1967 | Dickard et al. |
| 3,325,084 | A | 6/1967 | Ausnit |
| 3,326,399 | A | 6/1967 | Ausnit |
| 3,338,285 | A | 8/1967 | Jaster |
| 3,339,606 | A | 9/1967 | Kugler |
| 3,368,740 | A | 2/1968 | Rohde |
| 3,371,696 | A | 3/1968 | Ausnit |
| 3,387,640 | A | 6/1968 | Butler |
| 3,416,986 | A | 12/1968 | Carley |
| 3,417,675 | A | 12/1968 | Ausnit |
| 3,425,469 | A | 2/1969 | Ausnit |
| 3,425,618 | A | 2/1969 | Cohen |
| 3,456,867 | A | 7/1969 | Repko |
| 3,460,337 | A | 8/1969 | Feild |
| 3,462,068 | A | 8/1969 | Suominen |
| 3,471,005 | A | 10/1969 | Sexstone |
| 3,473,589 | A | 10/1969 | Gotz |
| 3,532,571 | A | 10/1970 | Ausnit |
| 3,535,409 | A | 10/1970 | Rohde |
| 3,543,343 | A | 12/1970 | Staller et al. |
| 3,565,147 | A | 2/1971 | Ausnit |
| 3,608,439 | A | 9/1971 | Ausnit |
| 3,619,395 | A | 11/1971 | Skendzic |
| 3,625,270 | A | 12/1971 | Skendzic |
| 3,633,642 | A | 1/1972 | Slegel |
| 3,655,503 | A | 4/1972 | Stanley et al. |
| 3,711,011 | A | 1/1973 | Kugler |
| 3,722,672 | A | 3/1973 | Ebata |
| 3,746,215 | A | 7/1973 | Ausnit et al. |
| 3,759,073 | A | 9/1973 | Rifkin |
| 3,780,781 | A | 12/1973 | Uramoto |
| 3,790,992 | A | 2/1974 | Herz |
| 3,818,963 | A | 6/1974 | Whitman |
| 3,827,472 | A | 8/1974 | Uramoto |
| 3,827,591 | A | 8/1974 | Spelman et al. |
| 3,839,128 | A | 10/1974 | Arai |
| 3,903,571 | A | 9/1975 | Howell |
| 3,909,887 | A | 10/1975 | Yoshida |
| 3,938,658 | A | 2/1976 | Rohde |
| 3,948,705 | A | 4/1976 | Ausnit |
| 3,953,661 | A | 4/1976 | Gulley |
| 3,991,801 | A | 11/1976 | Ausnit |
| 4,003,972 | A | 1/1977 | Herz |
| 4,112,990 | A | 9/1978 | Anderson |
| 4,118,166 | A | 10/1978 | Bartrum |
| 4,153,090 | A | 5/1979 | Rifkin |
| 4,189,050 | A | 2/1980 | Jensen et al. |
| 4,189,809 | A | 2/1980 | Sotos |
| 4,191,230 | A | 3/1980 | Ausnit |
| 4,196,030 | A | 4/1980 | Ausnit |
| 4,212,337 | A | 7/1980 | Kamp |
| 4,235,653 | A | 11/1980 | Ausnit |
| 4,240,241 | A | 12/1980 | Sanborn, Jr. |
| 4,241,865 | A | 12/1980 | Ferrell |
| 4,246,288 | A | 1/1981 | Sanborn, Jr. |
| 4,249,982 | A | 2/1981 | Ausnit |
| 4,252,238 | A | 2/1981 | Spiegelberg et al. |
| 4,279,677 | A | 7/1981 | Takahashi |
| 4,285,376 | A | 8/1981 | Ausnit |
| 4,295,919 | A | 10/1981 | Sutrina et al. |
| 4,309,233 | A | 1/1982 | Akashi |
| 4,337,889 | A | 7/1982 | Moertel |
| 4,363,345 | A | 12/1982 | Scheibner |
| 4,379,806 | A | 4/1983 | Korpman |
| 4,419,159 | A | 12/1983 | Herrington |
| 4,428,477 | A | 1/1984 | Cristofolo |
| 4,428,788 | A | 1/1984 | Kamp |
| 4,430,070 | A | 2/1984 | Ausnit |
| 4,437,293 | A | 3/1984 | Sanborn, Jr. |
| 4,497,678 | A | 2/1985 | Nussbaum |
| 4,498,939 | A | 2/1985 | Johnson |
| 4,515,647 | A | 5/1985 | Behr |
| 4,518,087 | A | 5/1985 | Goglio |
| 4,522,305 | A | 6/1985 | Jacobsson |
| 4,528,224 | A | 7/1985 | Ausnit |
| 4,540,537 | A | 9/1985 | Kamp |
| 4,555,282 | A | 11/1985 | Yano |
| 4,561,109 | A | 12/1985 | Herrington |
| 4,573,203 | A | 2/1986 | Peppiatt |
| 4,582,549 | A | 4/1986 | Ferrell |
| 4,584,201 | A | 4/1986 | Boston |
| 4,589,145 | A | 5/1986 | Van Erden et al. |
| 4,601,694 | A | 7/1986 | Ausnit |
| 4,602,405 | A | 7/1986 | Sturman et al. |
| 4,615,083 | A | 10/1986 | Mayerhofer |
| 4,617,683 | A | 10/1986 | Christoff |
| 4,638,913 | A | 1/1987 | Howe, Jr. |
| 4,656,075 | A | 4/1987 | Mudge |
| 4,661,990 | A | 4/1987 | Rifkin |
| 4,664,649 | A | 5/1987 | Johnson et al. |
| 4,666,536 | A | 5/1987 | Van Erden et al. |
| 4,673,383 | A | 6/1987 | Bentsen |
| 4,682,366 | A | 7/1987 | Ausnit et al. |
| 4,698,118 | A | 10/1987 | Takahashi et al. |
| 4,709,533 | A | 12/1987 | Ausnit |
| 4,713,839 | A | 12/1987 | Peppiatt |
| 4,736,450 | A | 4/1988 | Van Erden et al. |
| 4,736,451 | A | 4/1988 | Ausnit |
| 4,744,674 | A | 5/1988 | Nocek |
| 4,755,247 | A | 7/1988 | Mudge |
| 4,755,248 | A | 7/1988 | Geiger et al. |
| 4,782,951 | A | 11/1988 | Griesbach et al. |
| 4,786,190 | A | 11/1988 | Van Erden et al. |
| 4,791,710 | A | 12/1988 | Nocek et al. |
| 4,817,188 | A | 3/1989 | Van Erden |
| 4,832,505 | A | 5/1989 | Ausnit et al. |
| 4,835,835 | A | 6/1989 | Gould |
| 4,846,585 | A | 7/1989 | Boeckmann et al. |
| 4,855,168 | A | 8/1989 | Imaizumi |
| 4,874,257 | A | 10/1989 | Inagaki |
| 4,875,587 | A | 10/1989 | Lulham et al. |
| 4,877,336 | A | 10/1989 | Peppiatt |
| 4,889,731 | A | 12/1989 | Williams, Jr. |
| 4,890,935 | A | 1/1990 | Ausnit et al. |
| 4,894,975 | A | 1/1990 | Ausnit |
| 4,895,198 | A | 1/1990 | Samuelson |
| 4,902,140 | A | 2/1990 | Branson |
| 4,923,309 | A | 5/1990 | Van Erden |
| 4,925,316 | A | 5/1990 | Van Erden et al. |
| 4,925,318 | A | 5/1990 | Sorensen |
| 4,927,271 | A | 5/1990 | Branson |
| 4,944,409 | A | 7/1990 | Busche et al. |
| 4,944,603 | A | 7/1990 | Cornish et al. |
| 4,947,525 | A | 8/1990 | Van Erden |

| | | | | |
|---|---|---|---|---|
| 4,966,470 | A | | 10/1990 | Thompson et al. |
| 4,969,967 | A | | 11/1990 | Sorensen et al. |
| 4,971,454 | A | | 11/1990 | Branson et al. |
| 5,005,707 | A | | 4/1991 | Hustad et al. |
| 5,007,142 | A | | 4/1991 | Herrington |
| 5,007,143 | A | | 4/1991 | Herrington |
| 5,010,627 | A | | 4/1991 | Herrington et al. |
| 5,017,021 | A | | 5/1991 | Simonsen et al. |
| 5,020,194 | A | | 6/1991 | Herrington et al. |
| 5,022,530 | A | | 6/1991 | Zieke |
| 5,023,122 | A | | 6/1991 | Boeckmann et al. |
| 5,024,537 | A | | 6/1991 | Tilman |
| 5,031,944 | A | | 7/1991 | Keyaki |
| 5,033,868 | A | | 7/1991 | Peppiatt |
| 5,035,518 | A | | 7/1991 | McClintock |
| RE33,674 | E | | 8/1991 | Uramoto |
| 5,063,069 | A | | 11/1991 | Van Erden et al. |
| 5,063,644 | A | | 11/1991 | Herrington et al. |
| 5,065,899 | A | | 11/1991 | Tilman |
| 5,066,444 | A | | 11/1991 | Behr |
| 5,067,208 | A | | 11/1991 | Herrington et al. |
| 5,067,822 | A | | 11/1991 | Wirth et al. |
| 5,070,583 | A | | 12/1991 | Herrington |
| 5,088,971 | A | | 2/1992 | Herrington |
| 5,092,684 | A | | 3/1992 | Weeks |
| 5,092,831 | A | | 3/1992 | James et al. |
| 5,094,357 | A | | 3/1992 | McKinney |
| 5,100,246 | A | | 3/1992 | La Pierre et al. |
| 5,112,138 | A | | 5/1992 | Peppiatt |
| 5,116,301 | A | | 5/1992 | Robinson et al. |
| 5,121,997 | A | | 6/1992 | La Pierre et al. |
| 5,127,208 | A | | 7/1992 | Custer et al. |
| 5,129,734 | A | | 7/1992 | Van Erden |
| 5,131,121 | A | | 7/1992 | Herrington et al. |
| 5,152,613 | A | | 10/1992 | Herrington, Jr. |
| 5,161,286 | A | | 11/1992 | Herrington, Jr. et al. |
| 5,186,543 | A | | 2/1993 | Cochran |
| 5,189,764 | A | | 3/1993 | Herrington et al. |
| 5,198,055 | A | | 3/1993 | Wirth et al. |
| 5,211,482 | A | | 5/1993 | Tilman |
| 5,215,381 | A | | 6/1993 | Wade |
| 5,224,779 | A | | 7/1993 | Thompson et al. |
| 5,253,395 | A | | 10/1993 | Yano |
| 5,283,932 | A | | 2/1994 | Richardson et al. |
| RE34,554 | E | | 3/1994 | Ausnit |
| 5,301,394 | A | | 4/1994 | Richardson et al. |
| 5,301,395 | A | | 4/1994 | Richardson et al. |
| 5,352,041 | A | | 10/1994 | Fullerton et al. |
| 5,366,294 | A | | 11/1994 | Wirth et al. |
| 5,391,136 | A | | 2/1995 | Makowka |
| 5,405,478 | A | | 4/1995 | Richardson et al. |
| 5,405,629 | A | | 4/1995 | Marnocha et al. |
| 5,425,825 | A | | 6/1995 | Rasko et al. |
| 5,426,830 | A | | 6/1995 | Richardson et al. |
| 5,431,760 | A | | 7/1995 | Donovan |
| 5,435,864 | A | | 7/1995 | Machacek et al. |
| 5,442,837 | A | | 8/1995 | Morgan |
| 5,442,838 | A | | 8/1995 | Richardson et al. |
| 5,448,807 | A | | 9/1995 | Herrington et al. |
| 5,448,808 | A | | 9/1995 | Gross |
| 5,456,928 | A | | 10/1995 | Hustad et al. |
| 5,482,375 | A | | 1/1996 | Richardson et al. |
| 5,486,051 | A | | 1/1996 | May |
| 5,488,807 | A | | 2/1996 | Terrenzio et al. |
| 5,492,411 | A | | 2/1996 | May |
| 5,509,735 | A | | 4/1996 | May |
| 5,513,915 | A | | 5/1996 | May |
| 5,525,762 | A | | 6/1996 | Shafran et al. |
| 5,551,127 | A | | 9/1996 | May |
| 5,552,202 | A | | 9/1996 | May |
| 5,582,853 | A | | 12/1996 | Marnocha et al. |
| 5,606,846 | A | | 3/1997 | Raby et al. |
| 5,613,934 | A | | 3/1997 | May |
| 5,620,256 | A | | 4/1997 | Makrauer |
| 5,625,927 | A | | 5/1997 | Chu |
| 5,647,671 | A | | 7/1997 | May |
| 5,664,299 | A | | 9/1997 | Porchia et al. |
| 5,669,715 | A | | 9/1997 | Dobreski et al. |
| 5,681,115 | A | | 10/1997 | Diederich et al. |
| 5,682,730 | A | | 11/1997 | Dobreski |
| 5,711,609 | A | | 1/1998 | Simonsen |
| 5,713,669 | A | * | 2/1998 | Thomas et al. ..... 383/61 X |
| 5,722,128 | A | | 3/1998 | Toney et al. |
| 5,725,312 | A | | 3/1998 | May |
| 5,767,184 | A | | 6/1998 | May |
| 5,775,812 | A | | 7/1998 | St. Phillips et al. |
| 5,782,733 | A | | 7/1998 | Yeager |
| 5,799,843 | A | | 9/1998 | Hsu |
| 5,823,933 | A | | 10/1998 | Yeager |
| 5,836,056 | A | | 11/1998 | Porchia et al. |
| 5,851,070 | A | | 12/1998 | Dobreski et al. |
| 5,855,434 | A | | 1/1999 | Hagen |
| 5,867,875 | A | | 2/1999 | Beck et al. |
| 5,875,611 | A | | 3/1999 | Plourde |
| 5,882,116 | A | | 3/1999 | Backus |
| 5,896,627 | A | | 4/1999 | Cappel et al. |
| 5,911,508 | A | | 6/1999 | Dobreski et al. |
| 5,919,535 | A | | 7/1999 | Dobreski et al. |
| 5,924,173 | A | | 7/1999 | Dobreski et al. |
| 5,924,795 | A | | 7/1999 | Thompson et al. |
| 5,938,337 | A | | 8/1999 | Provan et al. |
| 5,956,924 | A | | 9/1999 | Thieman |
| 5,964,532 | A | | 10/1999 | St. Phillips et al. |
| 5,989,708 | A | | 11/1999 | Kreckel |
| 6,010,244 | A | | 1/2000 | Dobreski et al. |
| 6,036,364 | A | | 3/2000 | Heuvel |
| 6,131,369 | A | | 10/2000 | Ausnit |
| 6,212,857 | B1 | * | 4/2001 | Van Erdern ..... 493/213 X |
| 6,247,843 | B1 | | 6/2001 | Buchman |
| 6,257,763 | B1 | * | 7/2001 | Stolmeier et al. ..... 383/5 |
| 6,264,366 | B1 | * | 7/2001 | Custer ..... 383/5 |
| 6,273,607 | B1 | * | 8/2001 | Buchman ..... 383/5 |
| 6,287,000 | B1 | * | 9/2001 | Buchman ..... 383/5 |
| 6,287,001 | B1 | | 9/2001 | Buchman |
| 6,290,390 | B1 | * | 9/2001 | Buchman ..... 383/5 |
| 6,290,391 | B1 | * | 9/2001 | Buchman ..... 383/5 |
| 6,347,885 | B1 | * | 2/2002 | Buchman ..... 383/5 |
| 6,409,384 | B1 | * | 6/2002 | Provan et al. ..... 383/5 |
| 6,467,956 | B1 | | 10/2002 | Tilman et al. |
| 2002/0015537 | A1 | * | 2/2002 | Strand et al. ..... 383/5 |
| 2002/0071617 | A1 | * | 6/2002 | Bois ..... 383/5 |

FOREIGN PATENT DOCUMENTS

| | | |
|---|---|---|
| EP | 0 302 144 | 2/1989 |
| EP | 0 239 319 | 9/1990 |
| EP | 0 528 721 A2 | 2/1993 |
| EP | 0 374 539 | 8/1993 |
| EP | 0 405 995 | 3/1994 |
| EP | 0 941 937 A1 | 9/1999 |
| FR | 672430 | 9/1929 |
| FR | 1 350 126 | 12/1963 |
| FR | 2590236 | 5/1987 |
| FR | 2 613 326 | 10/1988 |
| FR | 2 771 387 | 5/1999 |
| GB | 386177 | 1/1932 |
| GB | 551074 | 2/1942 |
| GB | 1 546 433 | 5/1979 |
| GB | 2 080 412 | 2/1982 |
| GB | 2 130 173 | 5/1984 |
| GB | 2 268 721 | 1/1994 |
| GB | 2 268 731 | 1/1994 |
| JP | 57 105248 | 12/1980 |

| | | |
|---|---|---|
| WO | WO 9529604 | 11/1995 |
| WO | WO 9535046 | 12/1995 |
| WO | WO 9535047 | 12/1995 |
| WO | WO 9535048 | 12/1995 |
| WO | WO 9821993 | 5/1998 |
| WO | WO 98/45180 | 10/1998 |
| WO | WO 99/62781 | 12/1999 |

* cited by examiner

RECLOSABLE BAGS HAVING A REMOVABLE MEMBER ENCAPSULATING A SLIDER

This application is a divisional of U.S. Ser. No. 09/309,465, filed on May 11, 1999 which issued as U.S. Pat. No. 6,286,999 on Sep. 11, 2001.

FIELD OF THE INVENTION

The present invention generally relates to reclosable plastic bags and, more particularly, relates to a reclosable plastic bag having a tamper-evident feature. In one set of embodiments, the plastic bag has a zipper opened and closed using a slider mounted to the zipper, and the tamper-evident feature initially maintains the slider at a closed position on the zipper and allows the slider to move away from the closed position to an open position on the zipper in response to removing or breaking the tamper-evident feature. In another set of embodiments, the tamper-evident feature initially maintains a mouth portion of the plastic bag in a folded position and allows the mouth portion to be unfolded in response to removing or breaking the tamper-evident feature.

BACKGROUND OF THE INVENTION

Reclosable slider bags of the type disclosed in U.S. Pat. No. 5,067,208 include a zipper that is opened and closed by movement of a slider mounted to the zipper. Due to the ease of operating the slider, such slider bags have increased in popularity over the last few years. Heretofore, the primary market for slider bags has been consumers who purchase a package of empty slider bags and then fill the slider bags with products at home. However, with the increasing popularity of the slider bags, product manufacturers have become interested in packaging their food and nonfood products in slider bags for sale to consumers. The slider bags are a great convenience to the consumer who purchases these product-filled bags especially for products of the type where only a portion of the product is used at any given time. The product applications for which slider bags may be useful are virtually unlimited. The consumer may initially open the slider bag, use a portion of the product, and then easily reclose the slider bag. Due to the ease of using the slider bag, the slider bag is typically preferred over one-time openable bags, which are significantly more difficult to open and reclose. To open a one-time openable bag, the consumer may need to tear the bag open and may require a scissors or other tool to facilitate the opening process; to reclose the bag, the consumer typically must roll the top of the bag closed and may require an extra fastening mechanism such as a clip, tie, or tape to maintain the bag in the closed position.

A problem with plastic slider bags is that if such bags are to be prepackaged with a food or non-food product and then sold in a store, the contents of the plastic bags can easily be tampered with prior to purchase by the consumer. To inhibit such tampering, slider bags have been provided with tamper-evident features of the type disclosed in U.S. Pat. Nos. 5,669,715; 5,713,669; and 5,775,812. While such tamper-evident features are capable of providing tamper evidence upon opening the bag, bag manufacturers such as the assignee of the foregoing patents are continually striving to develop new bag features for improving the functionality of their bags.

SUMMARY OF THE INVENTION

To that end, the present invention provides a plastic bag comprising first and second opposing body panels fixedly connected to each other along a pair of sides and a bottom bridging the pair of sides. The bag is provided with a reclosable zipper extending along a mouth portion formed opposite the sealed bottom of the plastic bag. The zipper is preferably free of graspable upper pull flanges in order to best accommodate a slider and inhibit operation of the zipper without the slider. The slider is slidably mounted to the zipper for movement between a closed position and an open position. The zipper is closed while the slider is in the closed position. The zipper is opened in response to movement of the slider to the open position. The bag optionally includes end terminations at opposite ends of the zipper to prevent the slider from going past the ends of the zipper. To provide the plastic bag with tamper evidence, the bag includes a tamper-evident feature.

In one set of embodiments, the tamper-evident feature initially maintains the slider in the closed position and allows the slider to move away from the closed position toward the open position in response to removing or breaking the tamper-evident feature. The tamper-evident feature may take a variety of forms including for example: a removable cardboard, paper, or plastic member covering or adjacent to the slider in the closed position and adhered, stapled, friction fit, or connected in some other way to the bag to hold the member in place; a removable flexible member extending through a hole in the slider or through a hole in the zipper adjacent to the slider in the closed position; a removable stepped retaining element removably attached to one of the bag body panels near the closed position of the slider such that a shoulder of the slider is initially engaged to the stepped element and is disengaged therefrom upon removal of the stepped element; a latch connected to the end termination and releasably engaged to the slider in the closed position; a latch connected to the slider and releasably engaged to the end termination when the slider is in the closed position; and a removable U-shaped element extending through slots in the slider in the closed position and dug into the zipper.

The tamper-evident features noted above initially maintain the slider in the closed position. Therefore, prior to removing or breaking the tamper-evident feature, it is difficult to gain access to the interior of the bag because, in the absence of graspable upper flanges, the zipper is difficult to grasp and open by hand without the use of the slider. After the tamper-evident feature is removed or broken, the slider may be used to open the zipper and access the contents of the bag.

In another set of embodiments, the tamper-evident feature initially maintains the mouth portion of the plastic bag in a folded position and allows the mouth portion to be unfolded in response to removing or breaking the tamper-evident feature. The tamper-evident feature can be employed with both slider and sliderless bags and may take a variety of forms including for example: spot seals detachably sealing the sides of the folded mouth portion to the sides of the bag; spot seals detachably sealing the inner panel of the folded mouth portion to the adjacent bag panel; a removable flexible member passing through both the folded mouth portion and the adjacent unfolded portion of the bag; one or more stickers (adhesive strips) attaching the folded mouth portion to the adjacent unfolded portion of the bag; and combinations of the foregoing. If the flexible member or sticker is employed and the plastic bag includes a slider for operating the zipper, the flexible member or sticker may be strategically positioned to perform the dual function of maintaining the mouth portion in the folded position and preventing the slider from being moved away from the closed position until the flexible member or sticker is removed from the bag.

The tamper evident features of the present invention effectively inhibit tampering with contents of the bag to a degree that is especially useful for non-food and some food applications, where tamper-proof packaging is not required but tamper-resistant packaging is nonetheless desirable.

BRIEF DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENTS

Figure 1:
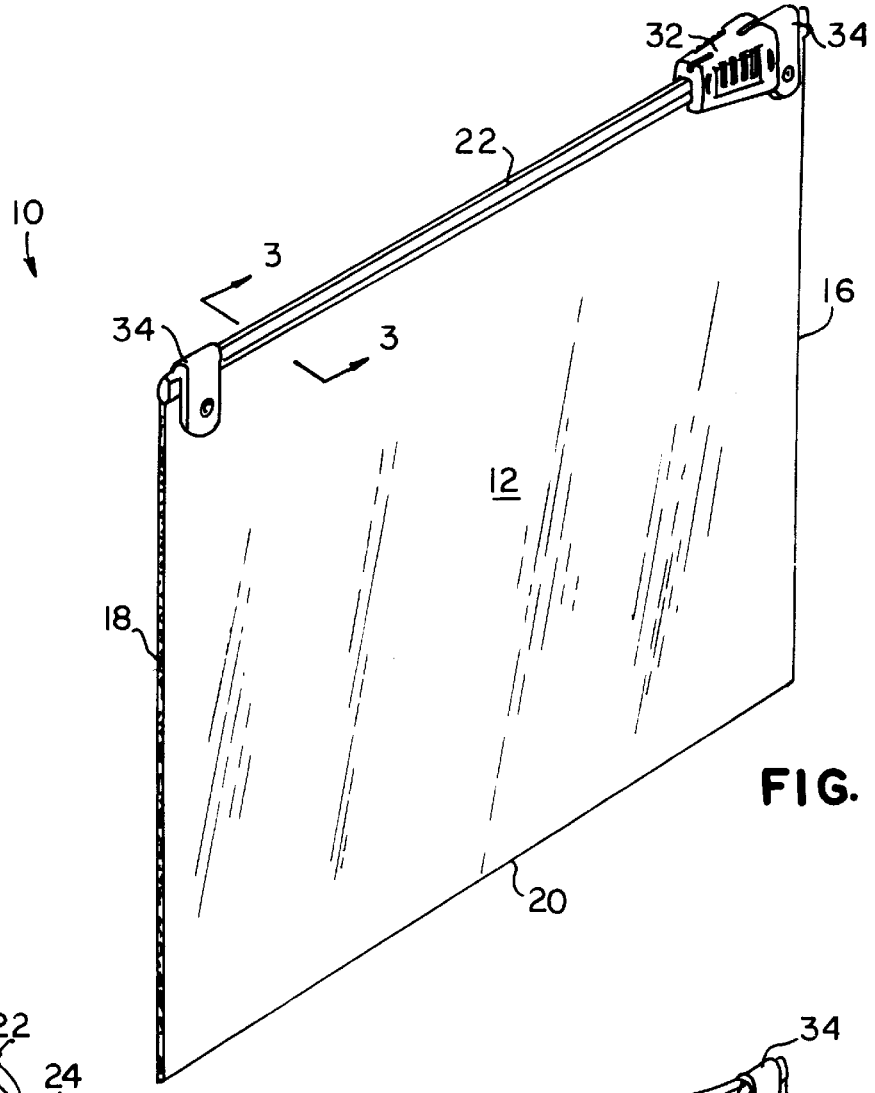
FIG. 1 is an isometric view of a reclosable plastic slider bag having a slider mounted to a zipper in a closed position.

Turning now to the drawings, FIG. 1 depicts a reclosable plastic slider bag 10 comprising first and second opposing body panels 12 and 14 fixedly connected to each other along a pair of sides 16 and 18 and a bottom 20 bridging the pair of sides 16 and 18. The bag is provided with a reclosable zipper 22 extending along a mouth portion formed opposite the closed bottom 20 of the plastic bag.

Figure 3:
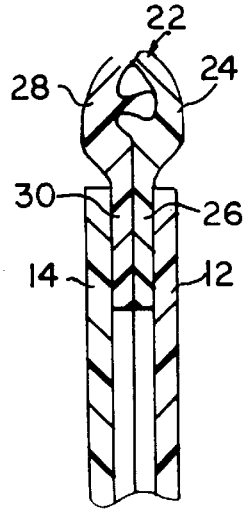
FIG. 3 is a sectional view taken generally along line 3—3 in FIG. 1.

Referring to FIG. 3, the zipper 22 includes a male track and a female track. The male track includes a male profile 24 and a first depending fin or flange 26 extending downward from the male profile 24. Likewise, the female track includes a female profile 28 and a second depending fin or flange 30 extending downward from the female profile 28. The first and second fins 26 and 30 are thermally fused to inner surfaces of the respective first and second body panels 12 and 14. Alternatively, the zipper 22 may be extruded with the body panels 12 and 14 such that the first fin 26 is integrally formed with the first body panel 12 and the second fin 30 is integrally formed with the second body panel 14. To provide a hermetic seal for the contents of the bag, the first and second fins 26 and 30 may be joined to each other at their lowermost ends along a line of weakness to effectively create a single tamper-evident continuous fin. If the fins are joined to each other, they must be separated from each other along the line of weakness in order to gain access to the contents of the bag. Further information concerning the joined fins may be obtained from U.S. application Ser. No. 08/950,535 filed Oct. 15, 1997 and entitled "Reclosable Fastener Strip With Tamper Evident Feature," which is incorporated herein by reference in its entirety.

Figure 2:
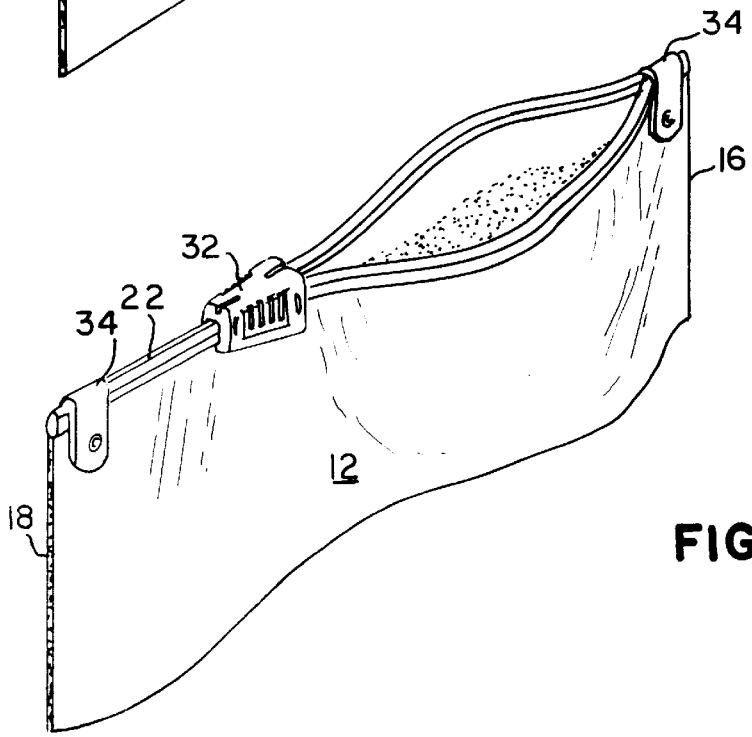
FIG. 2 is an isometric view of a mouth portion of the slider bag showing the slider moved away from the closed position so that the zipper is partially opened.

To assist in opening the plastic bag, a slider 32 is slidably mounted to the zipper 22 for movement between a closed position and an open position. In the closed position of the slider 32 shown in FIG. 1, the male and female profiles 24 and 28 are interlocked with each other. Movement of the slider 32 from the closed position in FIG. 1 toward the open position (see FIG. 2) disengages the male and female profiles 24 and 28 from each other and allows a user to gain access to the interior of the plastic bag. The zipper 22 is preferably free of graspable upper pull flanges extending upward from the profiles 24 and 28 in order to facilitate mounting and movement of the slider 32 along the zipper 22. Also, the absence of such upper pull flanges inhibits a user from opening and closing the zipper 22 without the use of the slider 32.

Opposite ends of the zipper 22 are provided with end termination clamps 34. Each end clamp 34 includes a strap member that wraps over the top of the zipper 22. To mount the strap to the zipper 22, one end of the strap is provided with a rivet-like member that is adapted to penetrate through the bag material and into a cooperating opening at the other end of the strap. The end clamps 34 perform the dual function of stops for the ends of the zipper 22 to prevent the slider 32 from going past the end of the zipper 22 and, in addition, they hold the male and female profiles 24 and 28 together to resist stresses applied to the profiles during normal use of the plastic bag. Further details concerning the construction and operation of the slider 32 and the end clamps 34 may be obtained from U.S. Pat. No. 5,067,208 to Herrington, Jr. et al., which is incorporated herein by reference in its entirety. The end terminations 34 are merely illustrative and may take other forms known in the art, such as those disclosed in U.S. Pat. Nos. 5,482,375; 5,448,807; 5,442,837; 5,405,478; 5,161,286; 5,131,121; and 5,088,971 and in U.S. application Ser. No. 08/698,923 filed Aug. 16, 1996 and entitled "End Posts for Plastic Zipper," all of which are incorporated herein by reference in their entireties.

To provide the plastic bag with tamper evidence, the bag includes a tamper-evident feature. In one set of embodiments depicted in FIGS. 4*a–d* through 16*a–d*, the tamper-evident feature initially maintains the slider 32 in the closed position (FIG. 1) and allows the slider 32 to move away from the closed position toward the open position (see FIG. 2) in response to removing or breaking the tamper-evident feature. Prior to removing or breaking the tamper evident feature, it is difficult to gain access to the interior of the bag because, in the absence of graspable upper flanges, the zipper 22 is difficult to grasp and open by hand without the use of the slider 32. The tamper-evident feature may take a variety forms which are discussed below in connection with FIGS. 4*a–d* through 16*a–d*.

Figure 4A:
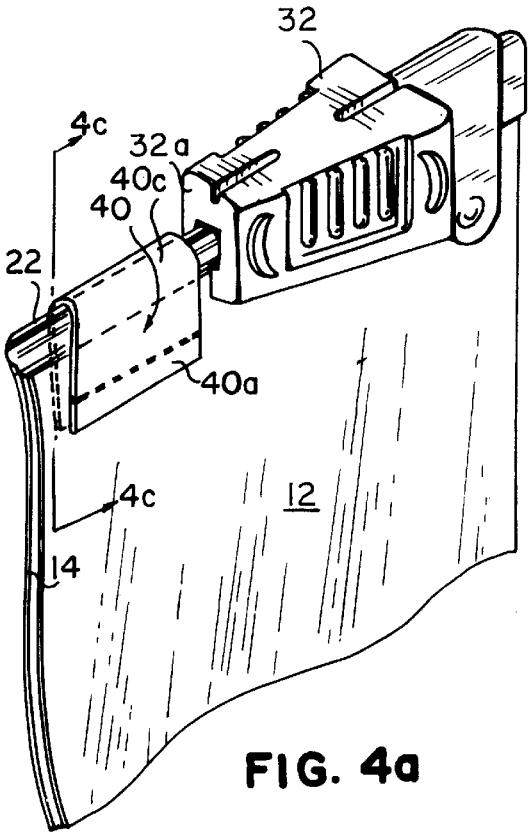
FIG. 4*a* is a partial isometric view of a slider bag having a tamper-evident feature in the form of a removable adhesive label.
Figure 4B:
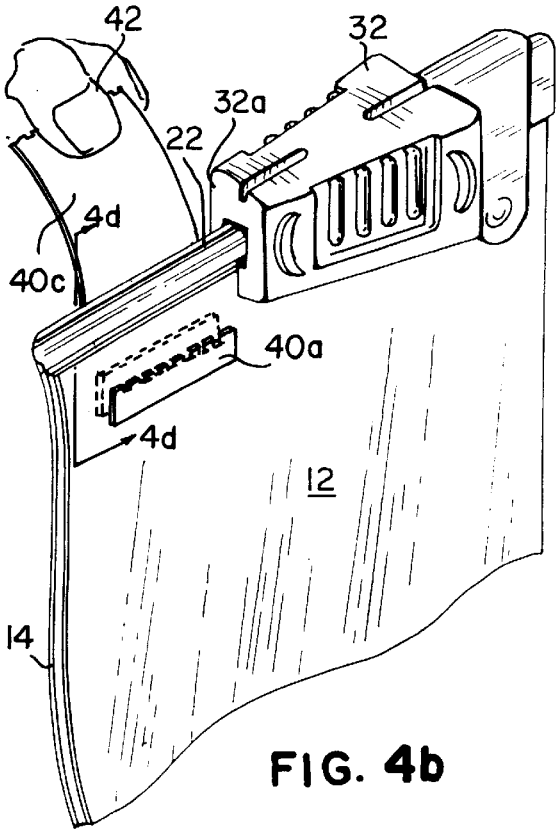
FIG. 4*b* is an enlarged isometric view of the slider bag showing the adhesive label in the process of being removed from the bag.
Figure 4C:
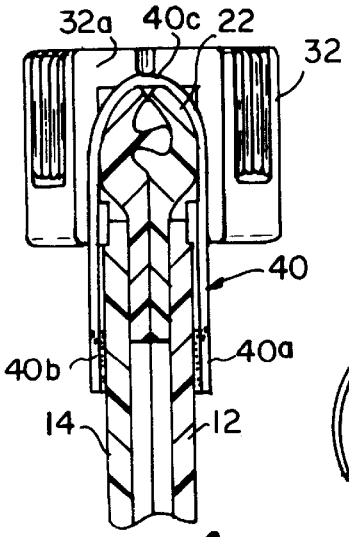
FIG. 4*c* is a sectional view taken generally along line 4*c*—4*c* in FIG. 4*a;*
Figure 4D:
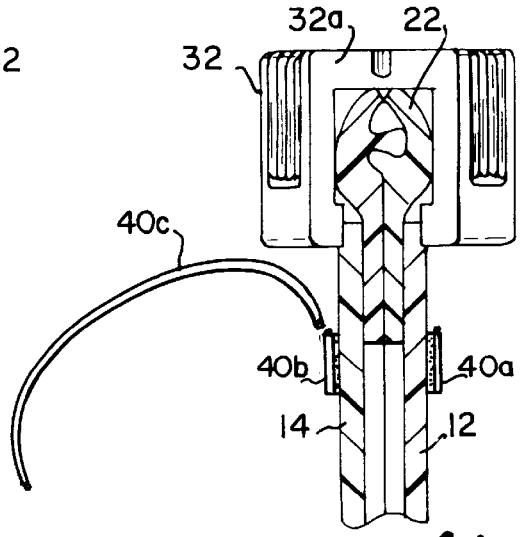
FIG. 4*d* is a sectional view taken generally along line 4*d*—4*d* in FIG. 4*b;*

Referring to FIGS. 4*a–d*, there is shown a tamper-evident feature in the form of a partially removable adhesive label 40 adjacent to the narrow closing end 32*a* of the slider 32 when the slider 32 is in the closed position on the zipper 22. Opposing end sections 40*a* and 40*b* of the label 40 are permanently adhered to outer surfaces of the opposing bag body panels 12 and 14, while a middle portion 40*c* of the label 40 is detachably connected to these end sections 40*a* and 40*b* along respective perforation lines. One or both ends of each perforation line may be provided with a notch to help initiate tearing along the perforation line. The middle portion 40*c* is either not adhered to the bag or is peelably adhered to the bag. Prior to removal, the label 40 extends over the zipper 22 as shown in FIGS. 4*a* and 4*c* so as to obstruct movement of the slider 32 away from the closed position. To allow movement of the slider 32 and thereby gain access to the interior of the bag, a user grasps the portion 40*c* of the label 40 extending over the zipper 22 and detaches this portion 40*c* from the end sections 40*a* and 40*b* as shown in FIGS. 4*b* and 4*d*. The end sections 40*a* and 40*b* remaining on the bag provide evidence of tampering. In an alternative embodiment, the label 40 does not include the perforation lines, but rather is removed using a cutting tool such as a scissors or knife.

Figure 5A:
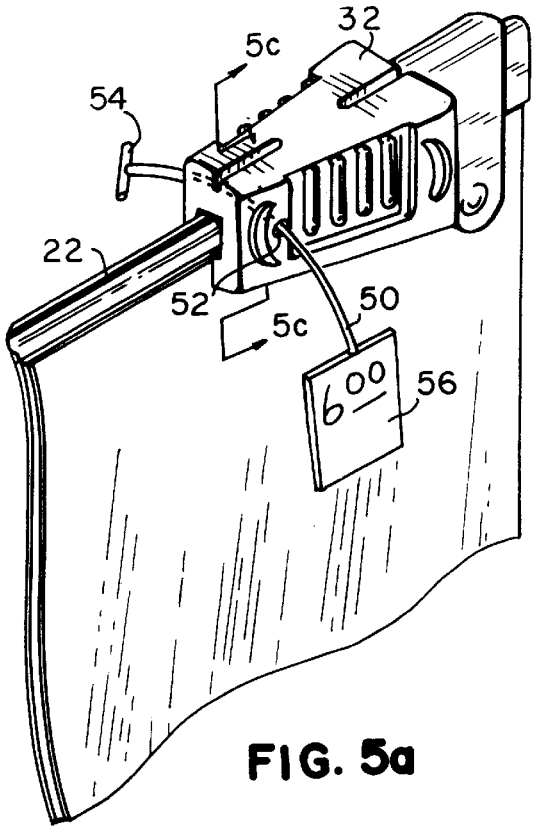
FIG. 5*a* is a partial isometric view of a slider bag having a tamper-evident feature in the form of a flexible member, such as a price tag pin, extending through a hole in the slider.
Figure 5B:
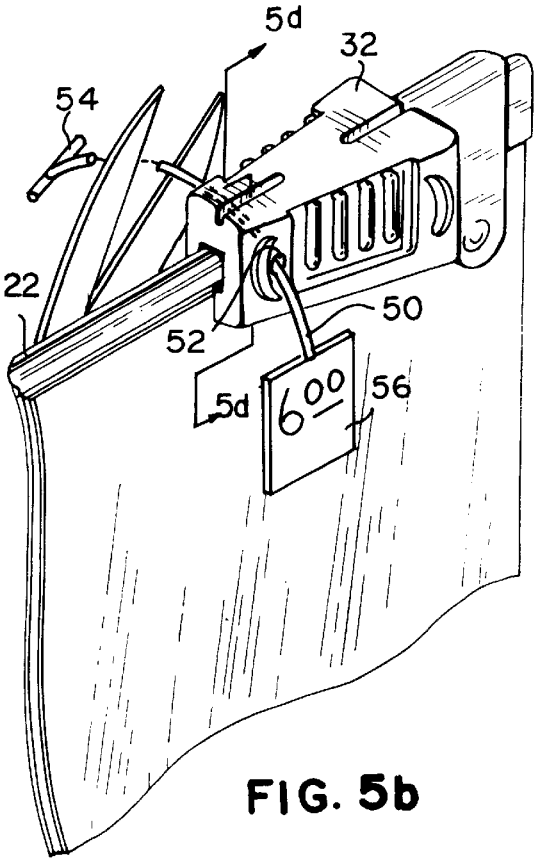
FIG. 5*b* is a partial isometric view of the slider bag showing the flexible member in the process of being cut away from the slider.
Figure 5C:
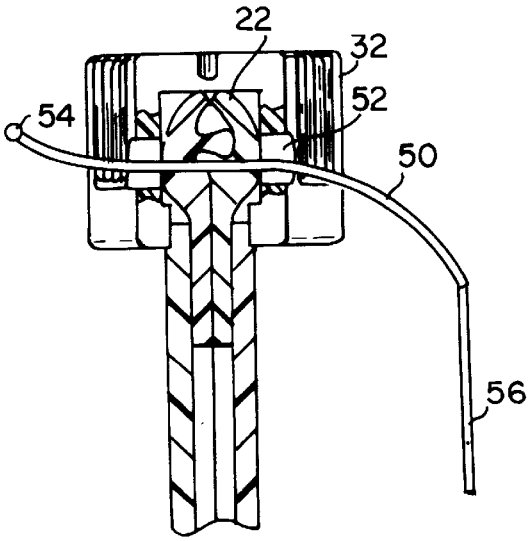
FIG. 5*c* is a sectional view taken generally along line 5*c*—5*c* in FIG. 5*a;*
Figure 5D:
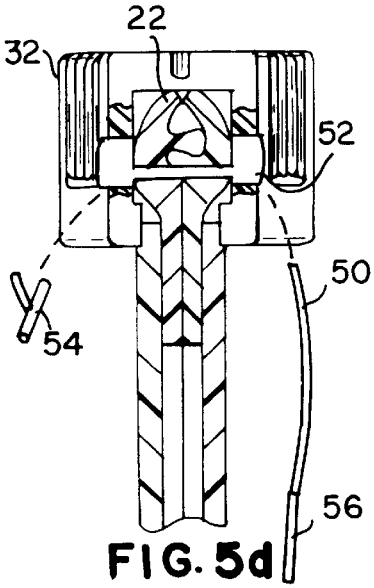
FIG. 5*d* is a sectional view taken generally along line 5*d*—5*d* in FIG. 5*b;*
Figure 6A:
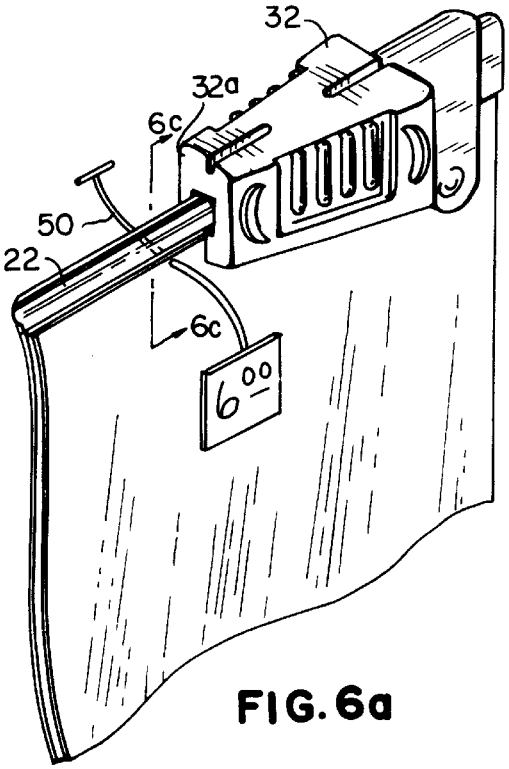
FIG. 6*a* is a partial isometric view of a slider bag having a tamper-evident feature in the form of flexible member, such as a price tag pin, extending through a hole in the zipper adjacent to the slider in the closed position.
Figure 6B:
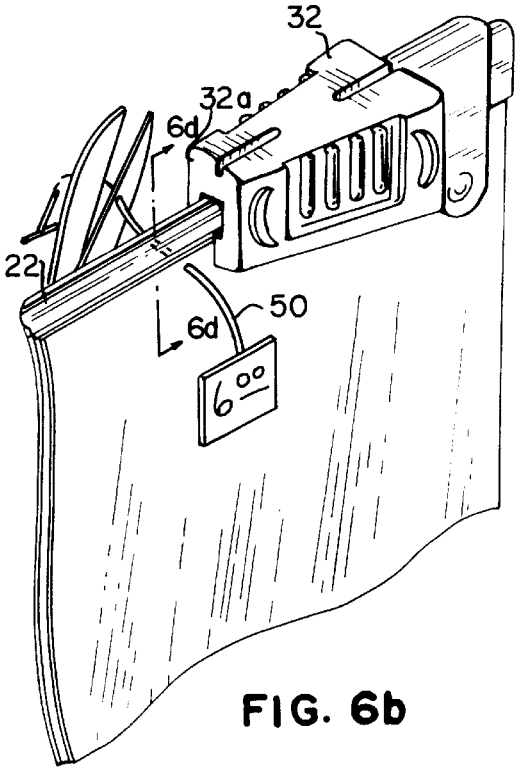
FIG. 6*b* is a partial isometric view of the slider bag showing the flexible member in the process of being cut away from the zipper.
Figure 6C:
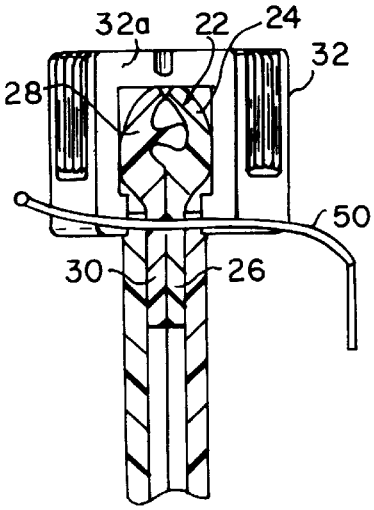
FIG. 6*c* is a sectional view taken generally along line 6*c*—6*c* in FIG. 6*a;*
Figure 6D:
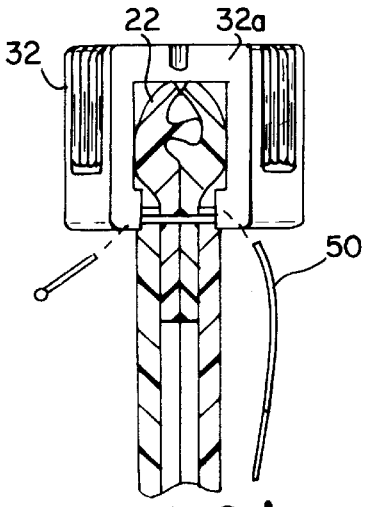
FIG. 6*d* is a sectional view taken generally along line 6*d*—6*d* in FIG. 6*b;*

Referring to FIGS. 5*a–d*, there is shown a tamper-evident feature in the form of a flexible member, such as a conventional plastic price tag pin 50, extending through a hole 52 in the slider 32 and through the zipper 22 when the slider 32 is in the closed position on the zipper 22. The price tag pin 50 includes a pair of stops 54 and 56 at its opposing ends to keep the pin 50 in place. Since the price tag pin 50 is anchored to the zipper 22, the slider 32 cannot be moved away from the closed position until the price tag pin 50 is clipped off the bag as shown in FIGS. 5*b* and 5*d*. As shown in FIGS. 6*a–d*, the price tag pin 50 may alternatively be anchored to the zipper 22 adjacent to the closing end 32*a* of the slider 32 when the slider 32 is in the closed position on the zipper 22. The zipper 22 includes the profiles 24 and 28 and the fins 26 and 30 extending downward from the respective profiles 24 and 28. The price tag pin 50 may extend through a hole in either the profiles 24 and 28 (not shown) or the fins 26 and 30 as shown in FIG. 6*c*. The pin 50 may extend through both the fins and the opposing body panels (as shown) or just the fins. Prior to removal of the pin 50, the pin 50 blocks movement of the slider 32 away from the closed position.

Figure 7A:
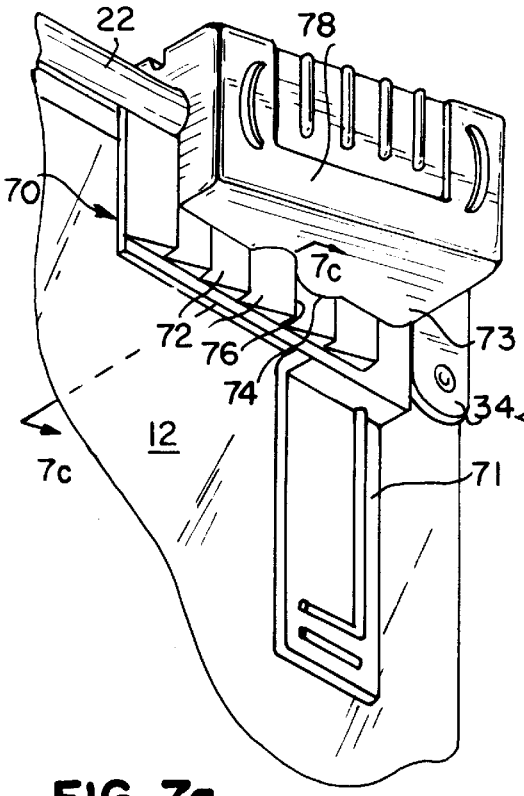
FIG. 7*a* is a partial isometric view of a slider bag having a tamper-evident feature in the form of a stepped retaining element attached to one of the bag body panels and engaging a shoulder of the slider in the closed position.
Figure 7B:
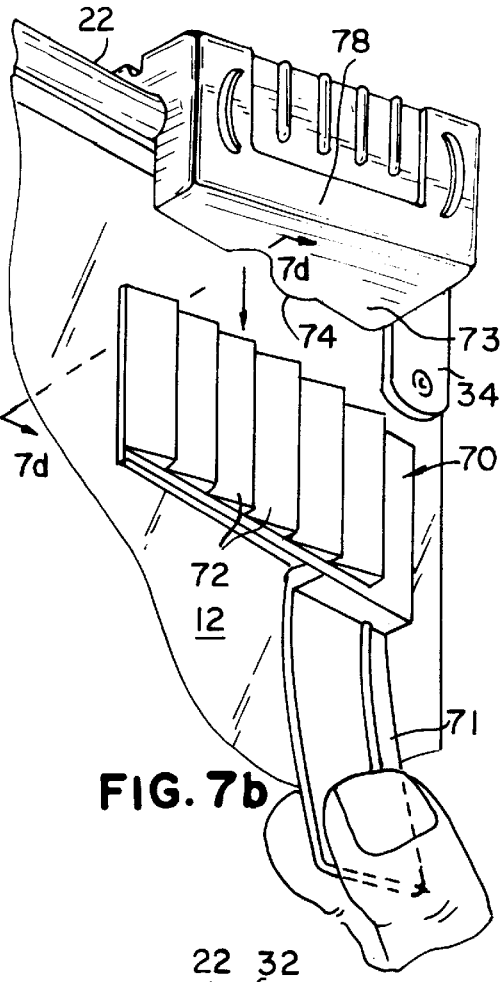
FIG. 7*b* is a partial isometric view of the slider bag showing the stepped retaining element in the process of being detached from the bag body panel and disengaged from the slider.
Figure 7C:
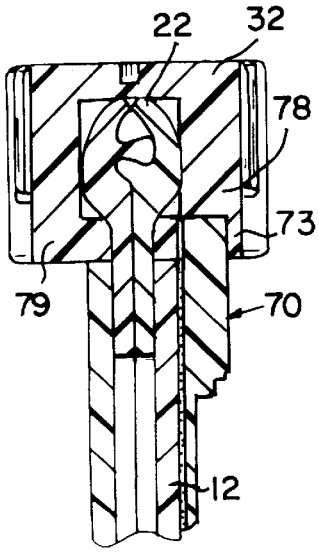
FIG. 7*c* is a sectional view taken generally along line 7*c*—7*c* in FIG. 7*a;*
Figure 7D:
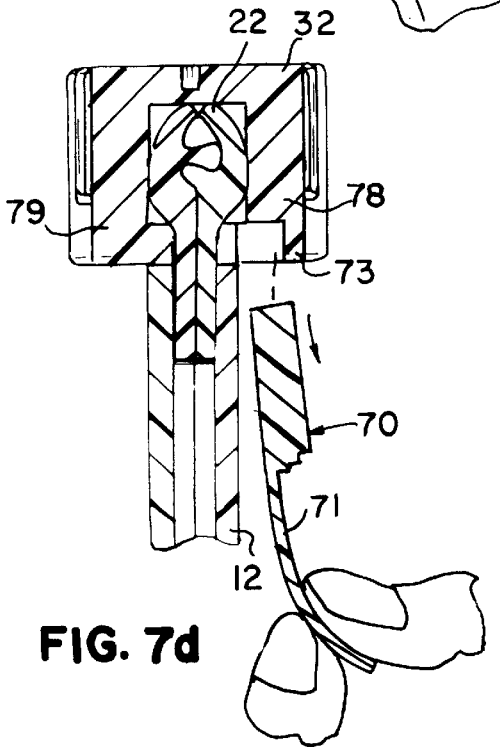
FIG. 7*d* is a sectional view taken generally along line 7*d*—7*d* in FIG. 7*b;*

Referring to FIGS. 7*a–d*, there is shown a tamper-evident feature in the form of a removable stepped retaining element 70 removably attached to the bag body panel 12 just below the zipper 22 at the closed position of the slider. The stepped element 70 may be attached to the bag body panel 12 by a peel seal or other weak adhesive that allows the stepped element 70 to be peeled or pried away as shown in FIGS. 7*b* and 7*d*. The stepped element 70 forms one or more steps 72 having respective sloped surfaces. The sloped surfaces of the respective steps 72 may be inclined such that each step 72 gradually increases in thickness in a direction approaching the end stop 34. To engage one of the steps 72, the slider 32 includes at least one inwardly extending shoulder 73 that is contoured to form a protrusion or bump 74. The protrusion 74 may be located anywhere along the shoulder 73. Further details concerning the contoured shoulder 73 may be obtained from U.S. application Ser. No. 08/938,047 filed Apr. 26, 1997, entitled "High-Strength Slider for a Reclosable Bag," and incorporated herein by reference in its entirety. When the slider 32 is in the closed position, the protrusion 74 on the slider shoulder 73 engages a raised edge 76 (FIG. 7*a*) on one of the steps 72.

To create the tamper-evident feature in FIGS. 7*a–d*, the stepped element 70 is preferably first adhered to the bag body panel 12. Subsequently, the slider 32 may be engaged to the stepped element 70 using a couple techniques. In one technique, if the slider 32 is of the wing-lock type disclosed in U.S. Pat. No. 5,067,208, the slider 32 may be installed on the zipper 22 at a location immediately above the stepped element 70. The wing-lock slider 32 includes a pair of hinged wings 78 and 79 that, prior to installing the slider 32 on the zipper 22, are spread away from each other in an open position (not shown). The wing 78 forms the shoulder 73 having the protrusion 74. The slider 32 is initially mounted to the zipper 22 above the stopped element with the wings 78 and 79 in the open or spread position, and then the wings 78 and 79 are rotated downward and latched in a closed position depicted in FIGS. 7*a–d*. As the wings 78 and 79 are latched in the closed position, the protrusion 74 engages the edge 76 of one of the steps 72. In another technique, the slider 32 is installed on the zipper 22 at a location away from the stepped element 70. The slider 32 is then moved along the zipper 22 to the closed position. When approaching the closed position, the slider shoulder 73 is forced over the stepped element 70 until the protrusion 74 engages the edge 76 of one of the steps 72.

To remove the stepped element 70 and thereby allow movement of the slider 32 away from the closed position, a user grasps a tab 71 of the stepped element 70 and peels or pries the stepped element 70 away from the bag body panel 12 as shown in FIGS. 7*b* and 7*d*.

Figure 7E:
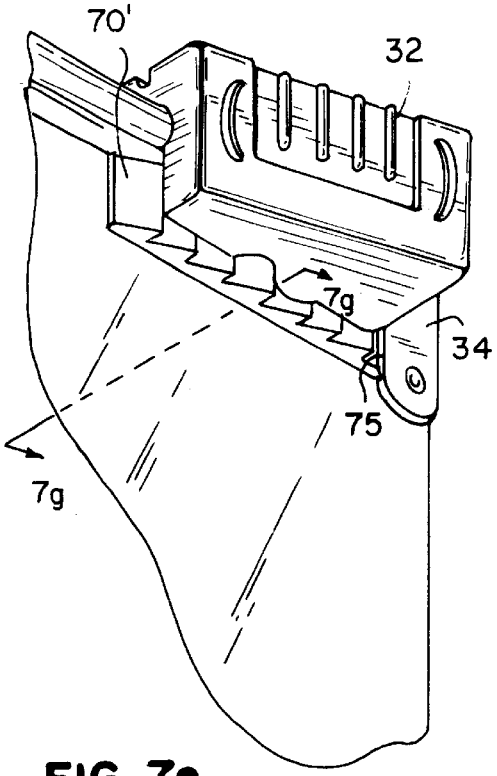
FIG. 7*e* is a partial isometric view of a slider bag having a tamper-evident feature in the form of a stepped retaining element integrally formed with a slider end stop and engaging a shoulder of the slider in the closed position.
Figure 7F:
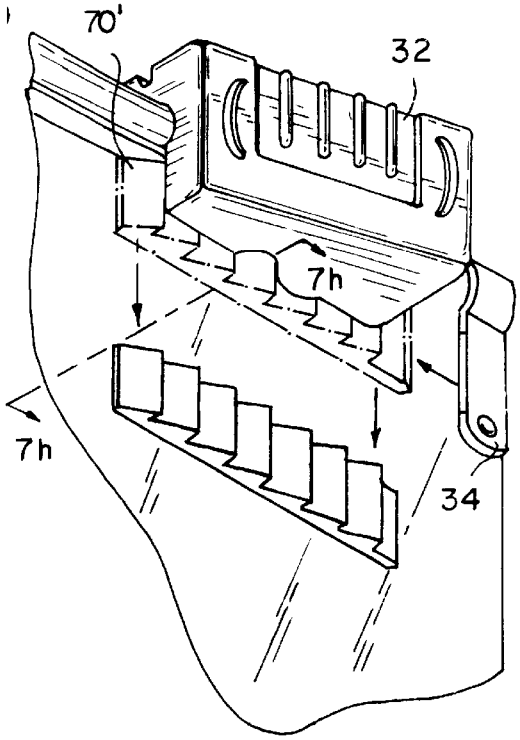
FIG. 7*f* is a partial isometric view of the slider bag showing the stepped retaining element in the process of being detached from the slider end stop and disengaged from the slider
Figure 7G:
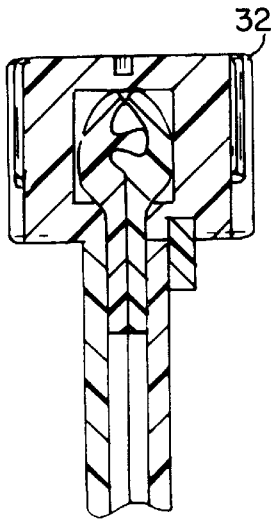
FIG. 7*g* is a sectional view taken generally along line 7*g*—7*g* in FIG. 7*e;*
Figure 7H:
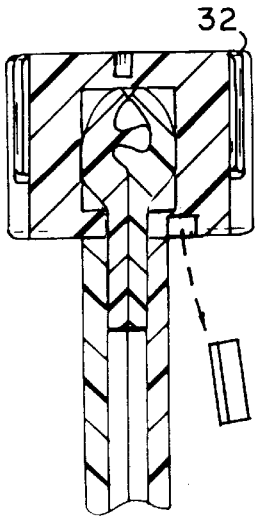
FIG. 7*h* is a sectional view taken generally along line 7*h*—7*h* in FIG. 7*f,*

Referring to FIGS. 7*e–h*, in an alternative embodiment a breakaway stepped element 70' is integrally formed with the end stop 34 and is detachably connected to the end stop 34 along a weakened area of connection 75 (FIG. 7*e*). To remove the stepped element 70', the slider 32 is forced away from the closed position as shown in FIG. 7*f* to break the weakened connection 75. The detached stepped element 70' is then removed from beneath the slider 32. To facilitate removal of the stepped element 70', a pull tab akin to the tab 71 in FIGS. 7*a–d* may be provided. Instead of detaching the stepped element 70' from the end stop 34 by forcibly moving the slider 32 away from the end stop 34, the stepped element 70' may alternatively be provided with a pull tab that is grasped and pulled by a user to first rupture the weakened connection 75 and then remove the detached stepped element 70' from beneath the slider 32.

Figure 8A:
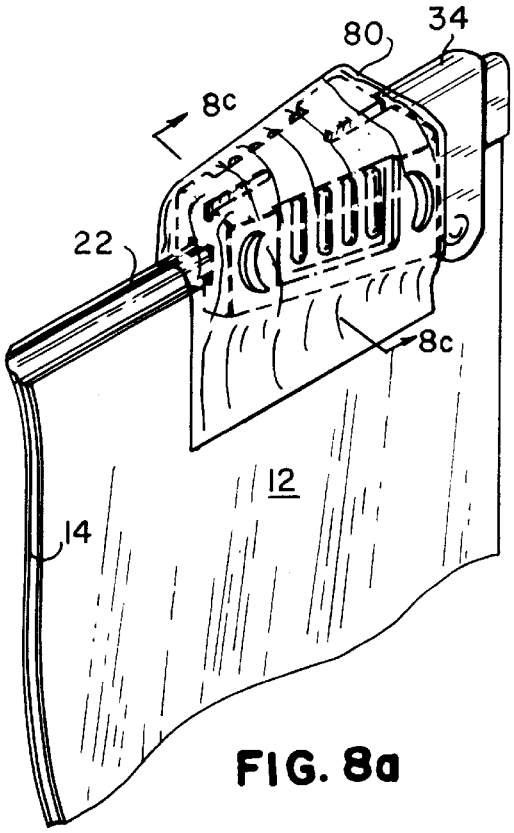
FIG. 8*a* is a partial isometric view of a slider bag having a tamper-evident feature in the form of shrink wrap encapsulating the slider in the closed position.
Figure 8B:
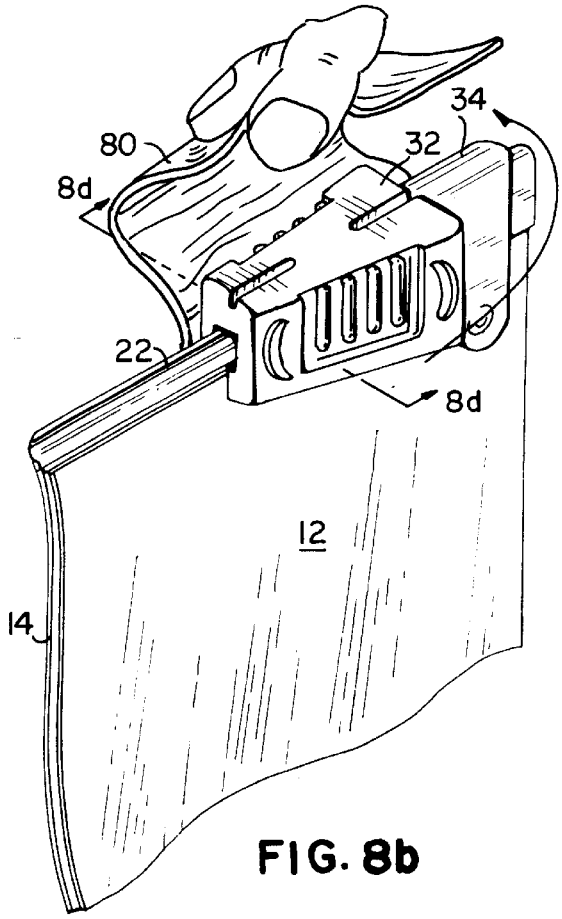
FIG. 8*b* is a partial isometric view of the slider bag showing the shrink wrap in the process of being removed from the bag.
Figure 8C:
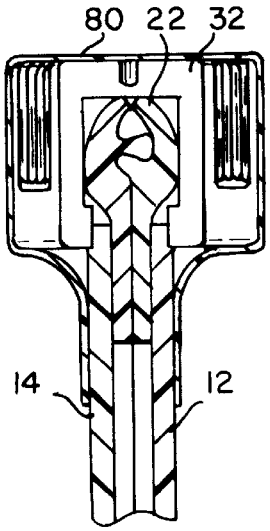
FIG. 8*c* is a sectional view taken generally along line 8*c*—8*c* in FIG. 8*a;*
Figure 8D:
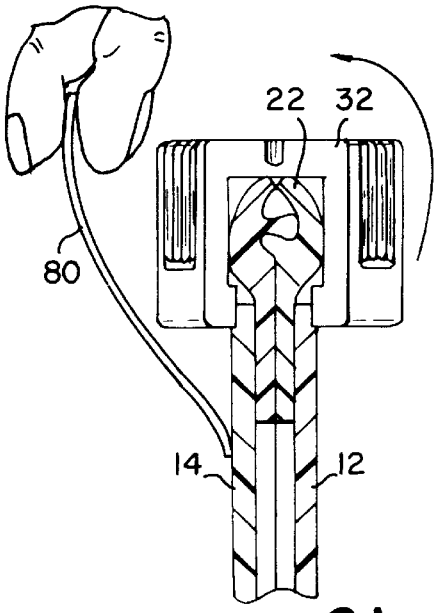
FIG. 8*d* is a sectional view taken generally along line 8*d*—8*d* in FIG. 8*b;*
Figure 8E:
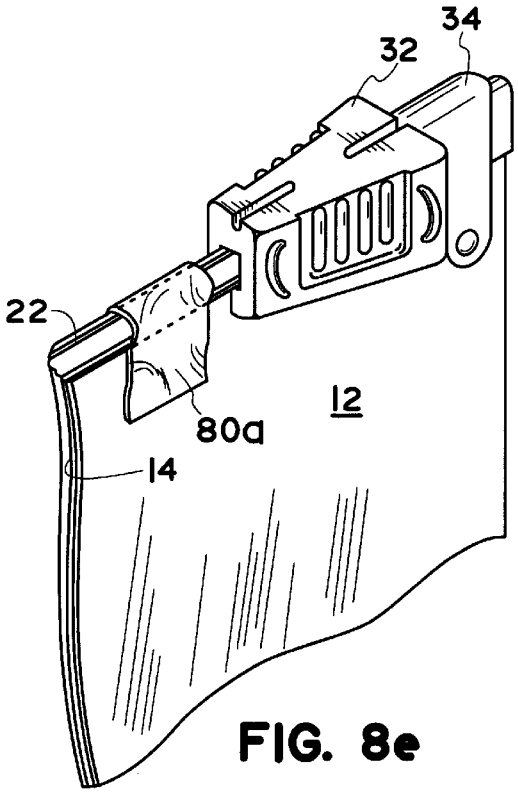
FIG. 8*e* is a partial isometric view of a slider bag having a tamper-evident feature in the form of a shrink wrap extending over the zipper in front of the slider in the closed position.
Figure 8F:
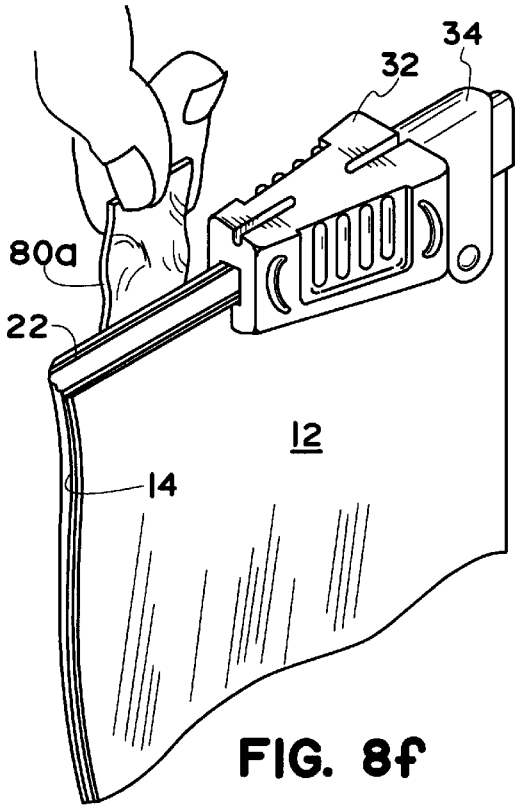
FIG. 8*f* is a partial isometric view of a slider bag showing the shrink wrap in the process of being removed from the bag.
Figure 8G:
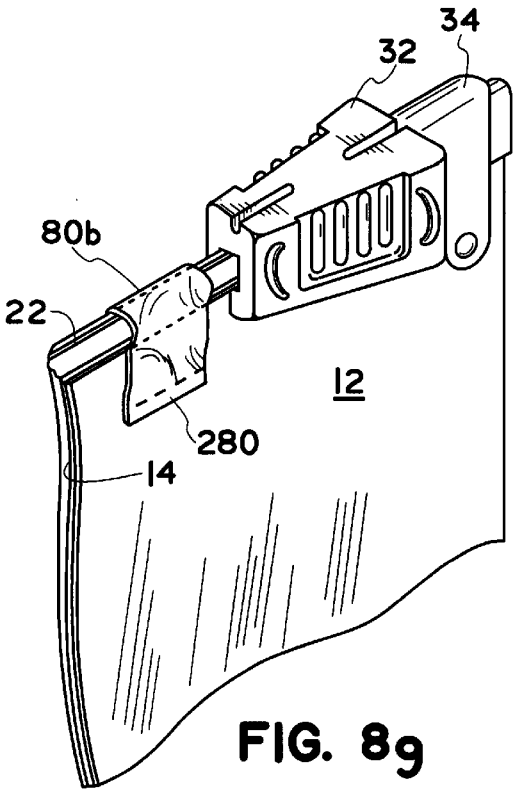
FIG. 8*g* is a partial isometric view of a slider bag having a tamper-evident feature in the form of a shrink wrap extending over the zipper in front of the slider in the closed position.
Figure 8H:
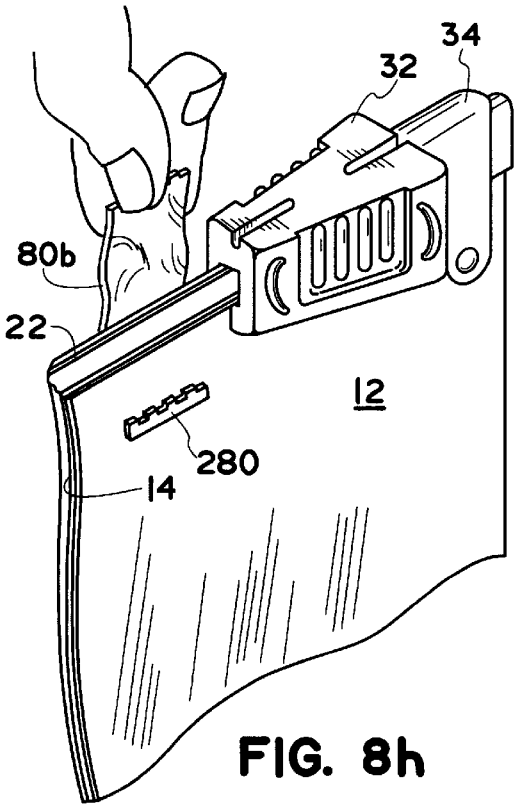
FIG. 8*h* is a partial isometric view of a slider bag showing the shrink wrap in the process of being removed from the bag.

Referring to FIGS. 8*a–d*, there is shown a tamper-evident feature in the form of removable-plastic shrink wrap 80 encapsulating the slider 32 when the slider 32 is in the closed position. The shrink wrap 80 is adhered or thermally fused to the bag body panels 12 and 14. The shrink wrap 80 may additionally encapsulate the end stop 34, in which case the shrink wrap 80 may only need to be attached to itself and not to the body panels in order to be held in place. Alternatively, the shrink wrap may be shrunk over the zipper 22 in front of the slider 32 as shown in FIGS. 8*e–*8*h*. To allow the slider 32 to be moved away from the closed position, the shrink wrap 80, 80*a*, 80*b* is torn or peeled away from the bag as shown in FIGS. 8*b*, 8*d*, 8*f* and 8*h*. The shrink wrap 80, 80*a*, 80*b* may be notched or perforated to facilitate its removal. Such perforations could be located along the top or sides of the shrink wrap 80, 80*a*, 80*b* depending upon the manner in which it is desired that the shrink wrap 80, 80*a*, 80*b* be torn away. For example, FIGS. 8*g* and 8*h* show a shrink wrap 80*b* having perforations along the sides of the shrink wrap 80*b*. It is contemplated that a portion of the shrink wrap 80, 80*a*, 80*b* could remain attached to the bag body panels 12 and 14 for tamper evidence after most of the shrink wrap 80, 80*a*, 80*b* is torn away, so long as the remaining portion does not interfere with the movement of the slider 32. Referring to FIGS. 8*g* and 8*h*, there is shown a shrink wrap 80*b* having portion 280 which remains attached to the bag body panel 12 for tamper evidence after most of the shrink wrap 8 Gb is torn away. Alternatively, portions of the shrink wrap could remain attached to both bag body panels 12 and 14 for tamper evidence after most of the shrink wrap is torn away.

Figure 9A:
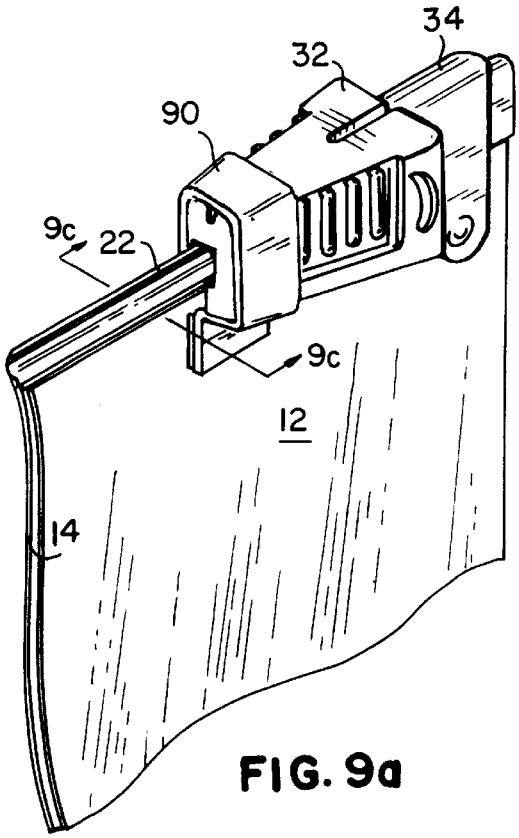
FIG. 9*a* is a partial isometric view of a slider bag having a tamper-evident feature in the form of a plastic sleeve covering at least a portion of the slider in the closed position.
Figure 9B:
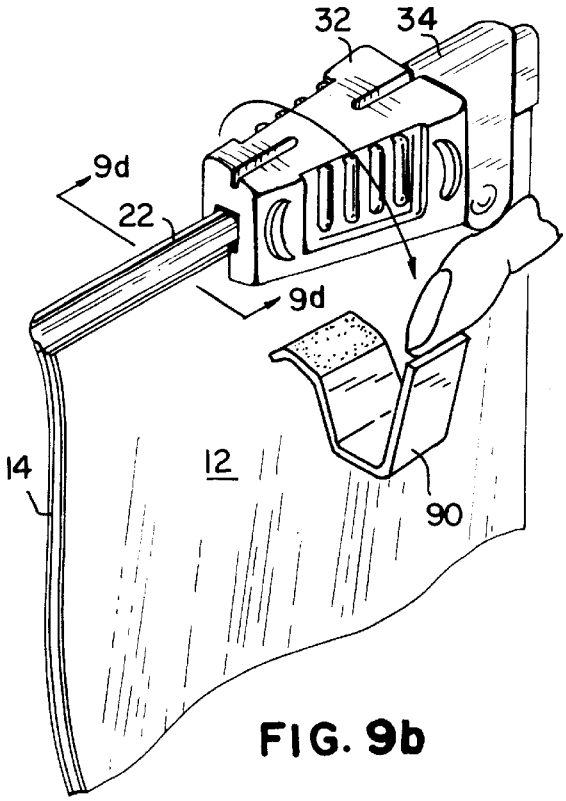
FIG. 9*b* is a partial isometric view of the slider bag showing the plastic sleeve in the process of being removed from the bag.
Figure 9C:
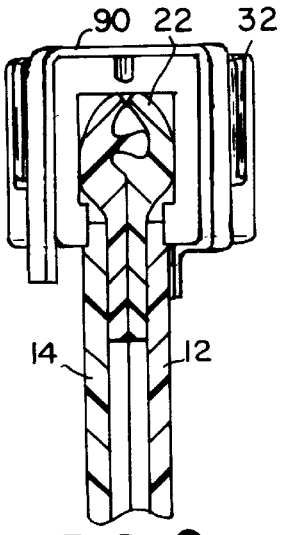
FIG. 9*c* is a sectional view taken generally along line 9*c*—9*c* in FIG. 9*a;*
Figure 9D:
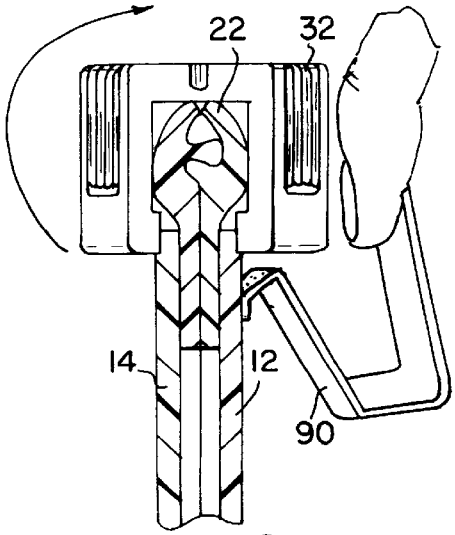
FIG. 9*d* is a sectional view taken generally along line 9*d*—9*d* in FIG. 9*b;*

Referring to FIGS. 9*a–d*, there is shown a tamper-evident feature in the form of a rigid or flexible plastic sleeve 90 partially covering the slider 32 when the slider 32 is in the closed position. Alternatively, the sleeve 90 may be increased in length to cover the entire slider 32. The sleeve 90 is either adhered or thermally fused to one or both of the bag body panels 12 and 14 as shown in FIGS. 9*a* and 9*c* or attached to the end stop 34 (not shown). To allow the slider 32 to be moved away from the closed position, the plastic sleeve 90 is torn or peeled away from the bag as shown in FIGS. 9*b* and 9*d*.

Figure 10A:
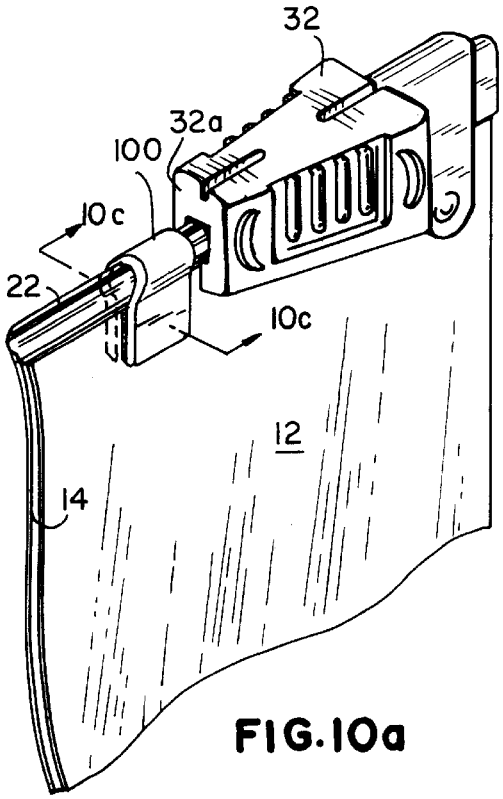
FIG. 10*a* is a partial isometric view of a slider bag having a tamper-evident feature in the form of an extruded friction fit plastic sleeve located adjacent to the slider in the closed position.
Figure 10B:
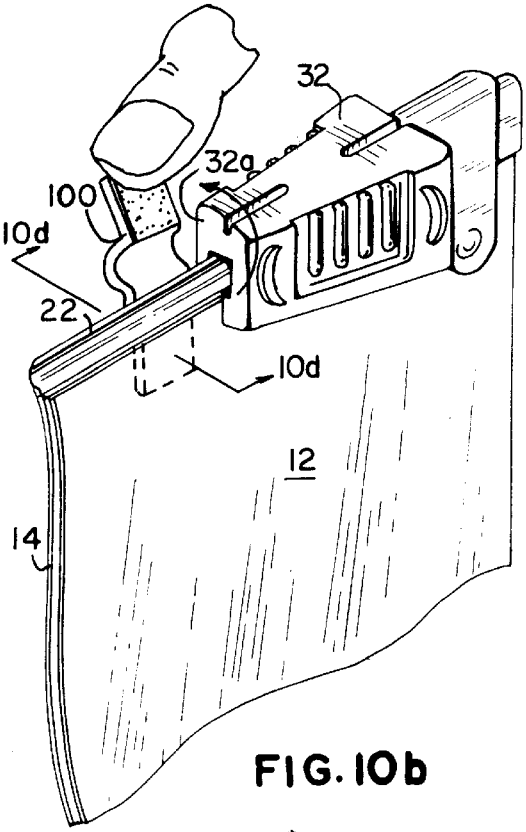
FIG. 10*b* is a partial isometric view of the slider bag showing the plastic sleeve in the process of being removed from the bag.
Figure 10C:
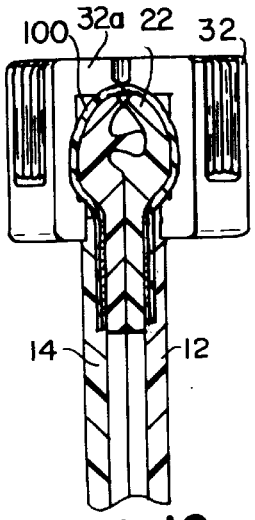
FIG. 10*c* is a sectional view taken generally along line 10*c*—10*c* in FIG. 10*a;*
Figure 10D:
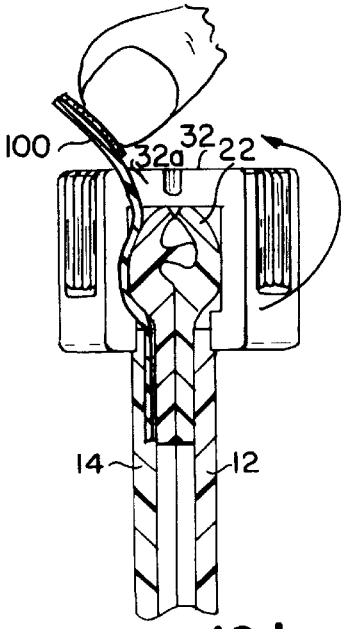
FIG. 10*d* is a sectional view taken generally along line 10*d*—10*d* in FIG. 10*b;*
Figure 11A:
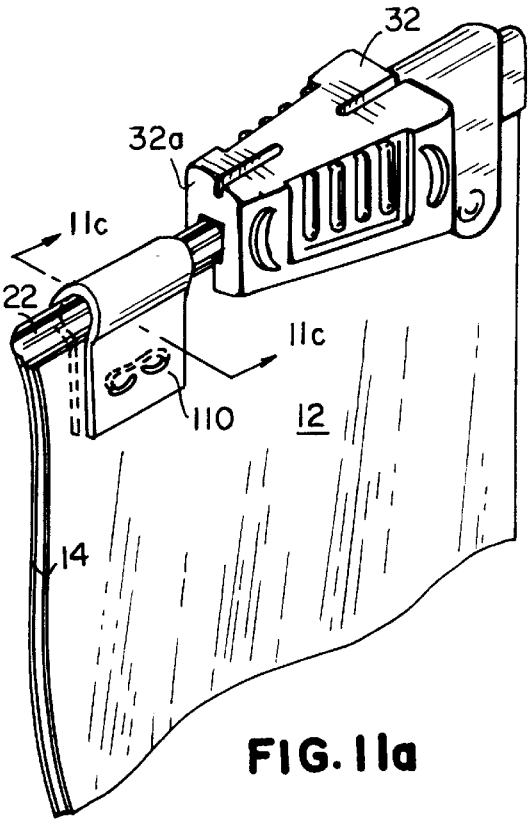
FIG. 11*a* is a partial isometric view of a slider bag having a tamper-evident feature in the form of a cardboard, paper, plastic, or foil strip stapled to the bag adjacent to the slider in the closed position.
Figure 11B:
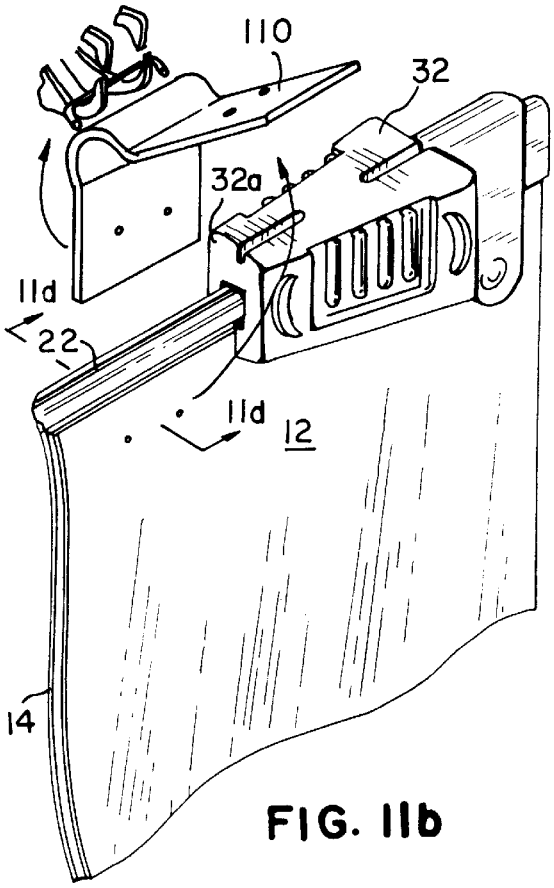
FIG. 11*b* is a partial isometric view of the slider bag showing the stapled strip in the process of being removed from the bag.
Figure 11C:
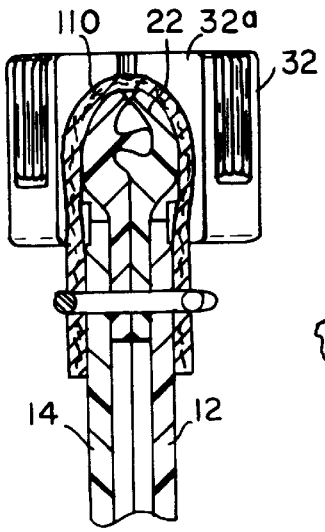
FIG. 11*c* is a sectional view taken generally along line 11*c*—11*c* in FIG. 11*a;*
Figure 11D:
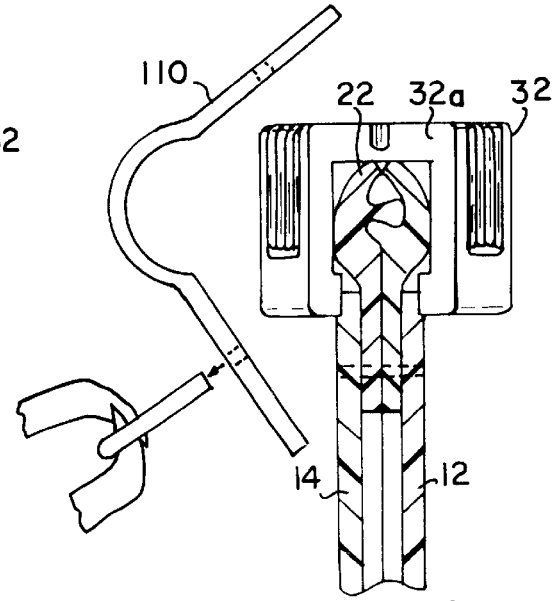
FIG. 11*d* is a sectional view taken generally along line 11*d*—11*d* in FIG. 11*b;*

Referring to FIGS. 10*a–d*, in an alternative embodiment a plastic sleeve 100 is mounted over the zipper 22 adjacent to the closing end 32*a* of the slider 32 when the slider is in the closed position. The sleeve 100 may be adhered or thermally fused to the bag body panels 12 and 14 and, additionally or alternatively, may be releasably connected to the zipper 22 by a friction fit. Also, the sleeve 100 may extend along only a short portion of the length of the zipper 22 as shown, or may extend along substantially the entire length of the zipper 22 less the region of the zipper 22 occupied by the slider 32. To achieve a strong friction fit between the sleeve 100 and the zipper 22, the sleeve 100 is preferably extruded to have an inner profile conforming to an outer profile of the zipper 22 as shown in FIG. 10*c*. When the sleeve 100 is mounted to the zipper 22, the sleeve 100 obstructs movement of the slider 32 away from the closed position. To allow the slider 32 to be moved away from the closed position, the sleeve 100 is pried off the zipper 22 either by pulling the entire sleeve 100 upward off the zipper 22 (not shown) or, if the sleeve 100 is sufficiently flexible, by releasing and lifting one side of the sleeve 100 as shown in FIGS. 10*b* and 10*d*.

Referring to FIGS. 11*a–d*, there is shown a tamper-evident feature in the form of a cardboard, paper, plastic, or foil strip 110 wrapped over the zipper 22 at a location adjacent to the closing end 32*a* of the slider 32 when the slider 32 is in the closed position. The strip 110 is stapled to the bag body panels 12 and 14. To allow the slider 32 to be moved away from its closed position, the staple is removed from the strip 110 which is, in turn, removed from the bag.

Figure 12A:
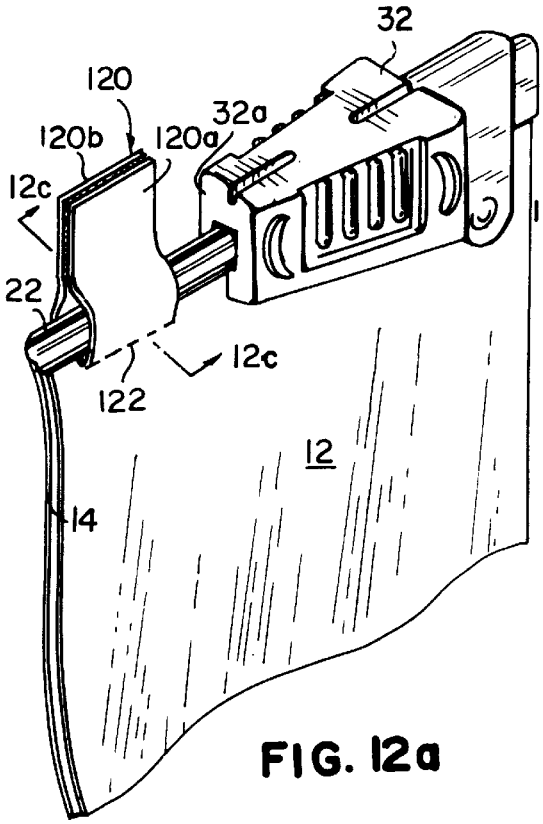
FIG. 12*a* is a partial isometric view of a slider bag having a tamper-evident feature in the form of a plastic tab located adjacent to the slider in the closed position, and including a pair of tab panels detachably connected to and extending upward from respective bag body panels and attached to each other above the zipper.
Figure 12B:
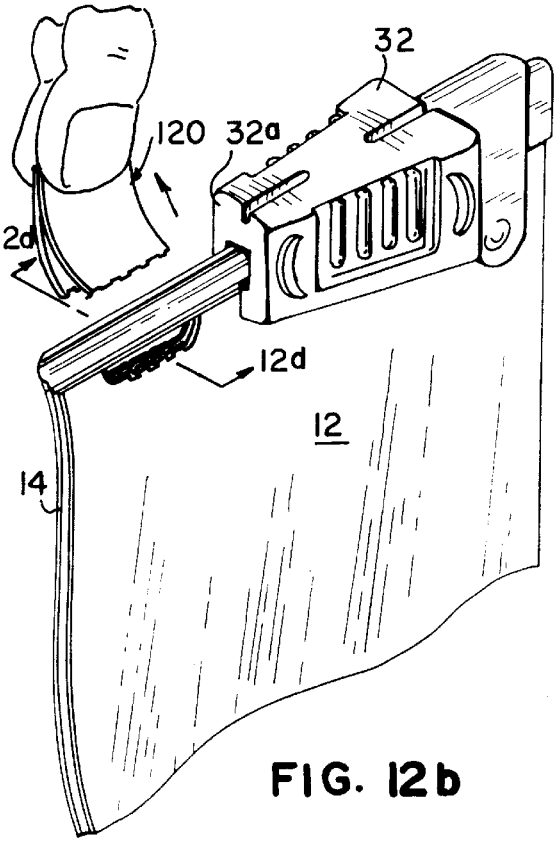
FIG. 12*b* is a partial isometric view of the slider bag showing the plastic tab in the process of being removed from the bag.
Figure 12C:
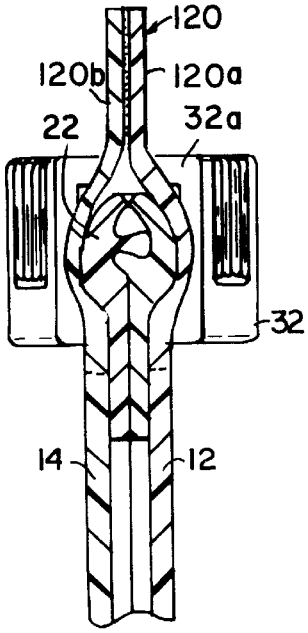
FIG. 12*c* is a sectional view taken generally along line 12*c*—12*c* in FIG. 12*a;*
Figure 12D:
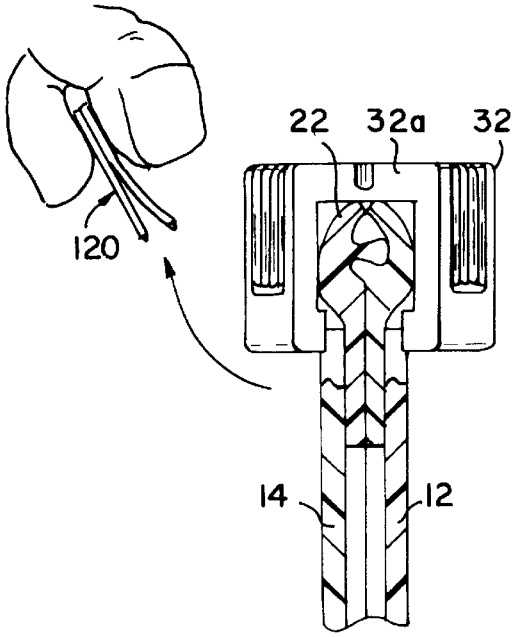
FIG. 12*d* is a sectional view taken generally along line 12*d*—12*d* in FIG. 12*b;*

Referring to FIGS. 12*a–d*, there is shown a tamper-evident feature in the form of a plastic tab 120 located adjacent to the closing end 32*a* of the slider 32 when the slider is in the closed position. The plastic tab 120 includes a pair of tab panels 120*a* and 120*b* (FIG. 12*c*) integrally formed with the respective bag body panels 12 and 14 and detachable therefrom along lines of weakness 122 (FIG. 12*a*). The lines of weakness may be perforations, scores, thinned areas, or the like. The tab panels 120*a* and 120*b* extend upwardly above the zipper 22 and are adhered or thermally fused to each other above the zipper 22. To allow the slider 32 to be moved away from its closed position, the tab panels 120*a* and 120*b* are grasped and pulled in a generally upward direction until they are broken away from the bag body panels 12 and 14 along the lines of weakness 122 as shown in FIGS. 12*b* and 12*d*. It is contemplated that a single tab panel maybe used in place of the pair of tab panels 120*a* and 120*b*.

Figure 13A:
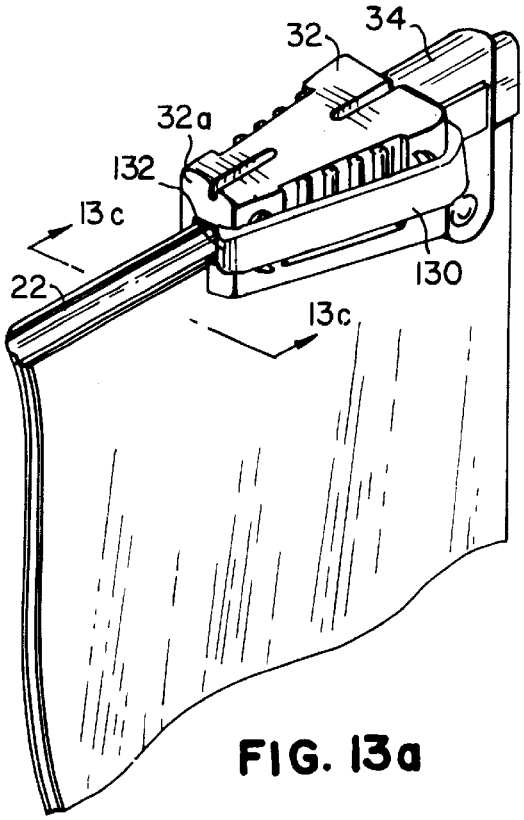
FIG. 13*a* is a partial isometric view of a slider bag having a tamper-evident feature in the form of a latch extending from a slider end stop and releasably engaged to the slider in the closed position.
Figure 13B:
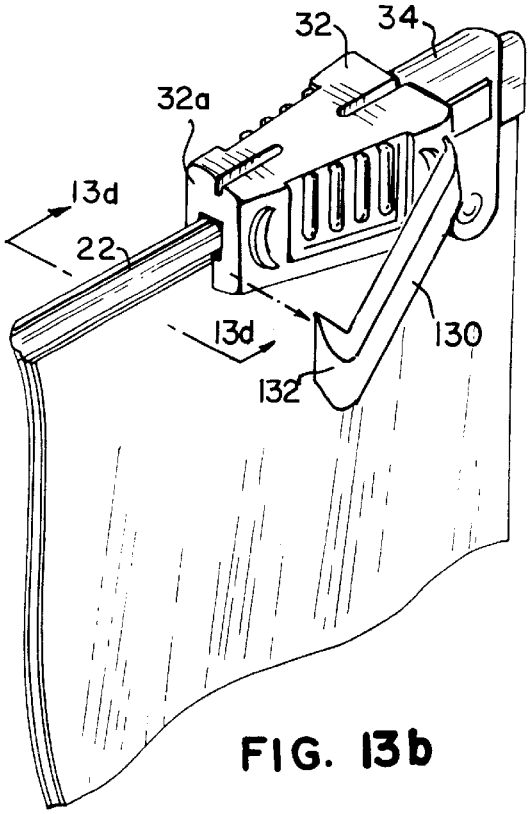
FIG. 13*b* is a partial isometric view of the slider bag showing the latch in the process of being disengaged from the slider
Figure 13C:
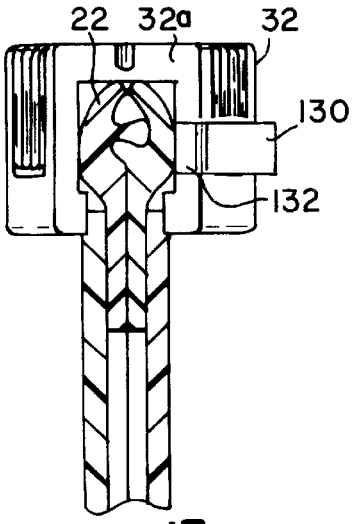
FIG. 13*c* is a sectional view taken generally along line 13*c*—13*c* in FIG. 13*a;*
Figure 13D:
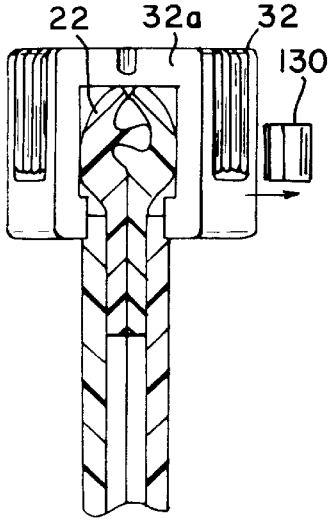
FIG. 13*d* is a sectional view taken generally along line 13*d*—13*d* in FIG. 13*b;*

Referring to FIGS. 13*a–d*, there is shown a tamper-evident feature in the form of a latch 130 extending from the end stop 34 and releasably engaged to the slider 32 when the slider 32 is in the closed position. The illustrated latch 130 is connected to the end stop 34 along a one-time breakable hinge that biases the latch 130 toward the position depicted in FIG. 13*a*. The latch 130 may extend along the side of the slider 32 as shown or, alternatively, may extend along the top wall of the slider 32. As shown in FIG. 13*a*, the latch 130 is shaped to extend about the exterior of the slider 32 and forms a distal hook 132 that engages the closing end 32*a* of the slider 32. Alternatively, the slider 32 may be modified to include a protruding tab, and the latch 130 may be adapted to engage the protruding tab. To allow the slider 32 to be moved away from its closed position, the latch 130 is pivoted outward away from the slider 32 until the hook 132 disengages from the slider 32 as shown in FIGS. 13*b* and 13*d*. The latch 130 is then torn away from the end stop 34 and discarded.

Figure 14A:
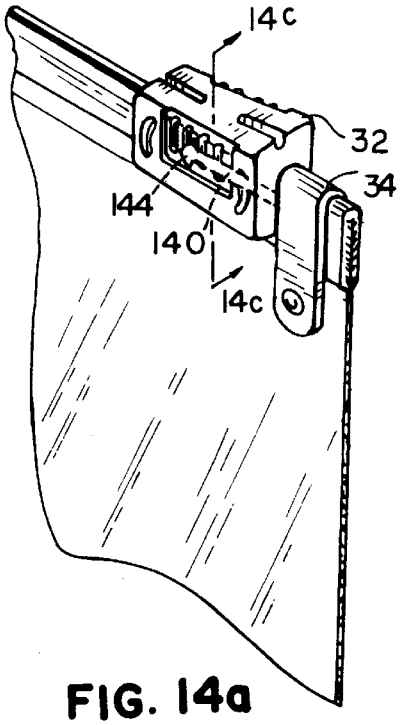
FIG. 14*a* is a partial isometric view of a slider bag having a tamper-evident feature in the form of a latch extending from a slider end stop and engaged to the slider in the closed position.
Figure 14B:
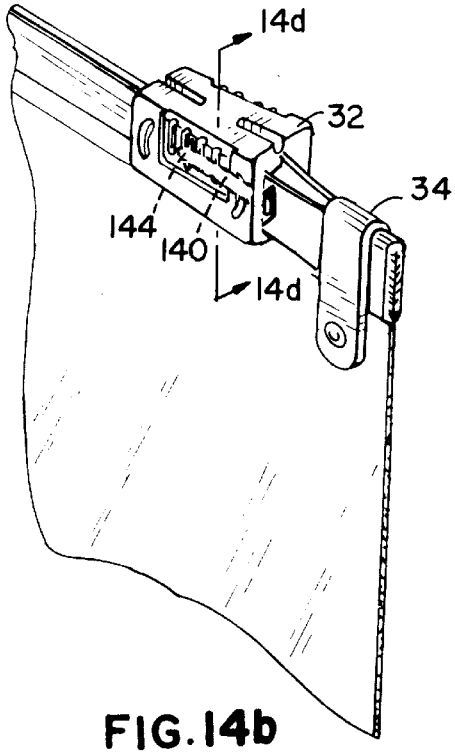
FIG. 14*b* is a partial isometric view of the slider bag showing the latch in the process of being broken to release the slider from the end stop.
Figure 14C:
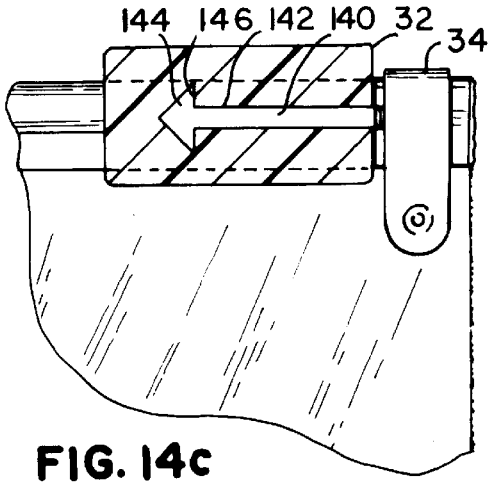
FIG. 14*c* is a sectional view taken generally along line 14*c*—14*c* in FIG. 14*a;*
Figure 14D:
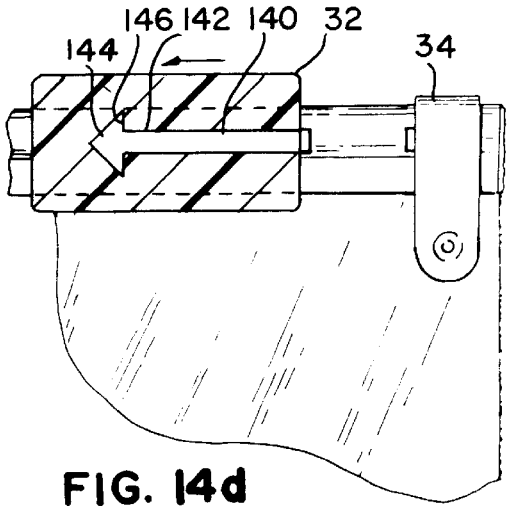
FIG. 14*d* is a sectional view taken generally along line 14*d*—14*d* in FIG. 14*b;*

Referring to FIGS. 14*a–d*, there is shown a tamper-evident feature in the form of an arrow-shaped latch 140 extending from the slider end stop 34 and engaged to the slider 32 when the slider 32 is in the closed position. The latch 140 is integrally formed with the end stop 34, and the slider 32 is initially injection molded with an elongated cavity 142 having a shape generally corresponding to the shape of the latch 140. The transverse dimension of the cavity is slightly greater than the transverse dimension of the latch 140. To "activate" the tamper-evident feature, the slider 32 is moved to the closed position such that the latch 140 is inserted into the cavity 142 and the barb-like head 144 of the latch 140 snappingly engages a shoulder 146 deep within the cavity 142. The latch head 144 is sufficiently flexible to allow the latch 140 to be inserted in the cavity 142 and, yet, its barb-like shape prevents the latch 140 from subsequently being extracted from the cavity 142. The installed latch 140 is depicted in FIGS. 14*a* and 14*c*. To allow the slider 32 to be moved away from its closed position, the slider 32 is simply grasped and moved away from the closed position with sufficient force to break the latch 140 away from the end stop 34 as shown in FIGS. 14*b* and 14*d*. The latch 140 remains captured within the cavity 142 of the slider 32.

Figure 15A:
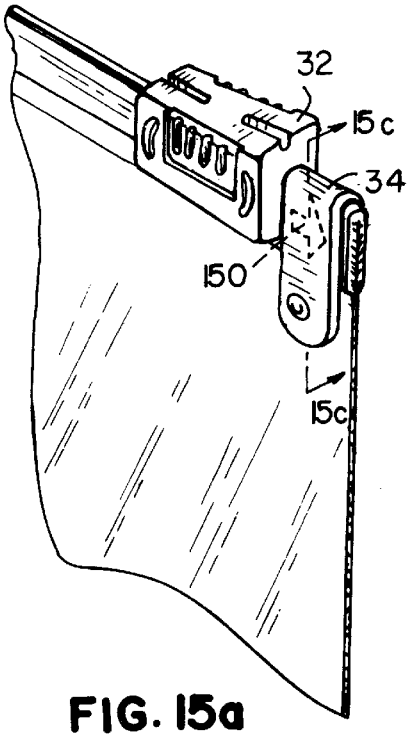
FIG. 15*a* is a partial isometric view of a slider bag having a tamper-evident feature in the form of a latch extending from the slider in the closed position and engaged to the slider end stop.
Figure 15B:
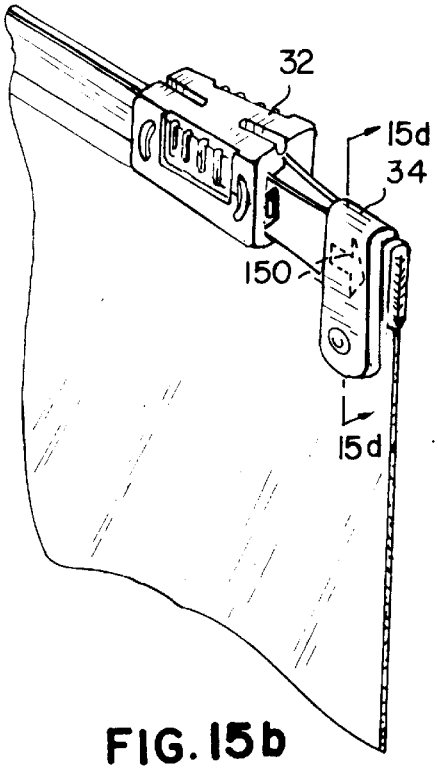
FIG. 15*b* is a partial isometric view of the slider bag showing the latch in the process of being broken to release the slider from the end stop.
Figure 15C:
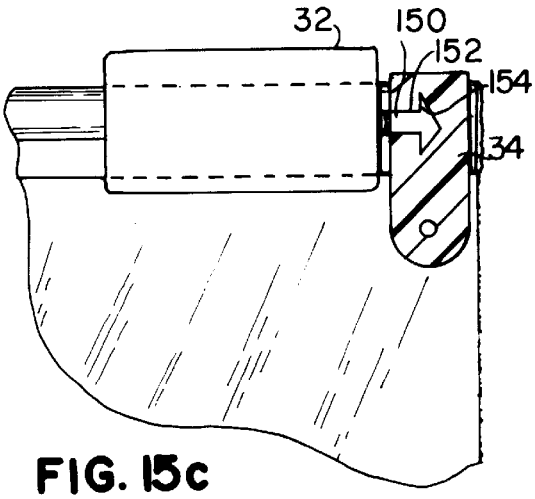
FIG. 15*c* is a sectional view taken generally along line 15*c*—15*c* in FIG. 15*a;*
Figure 15D:
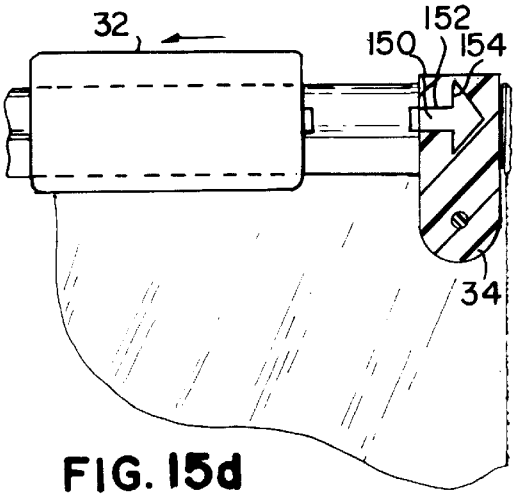
FIG. 15*d* is a sectional view taken generally along line 15*d*—15*d* in FIG. 15*b;*
Figure 16A:
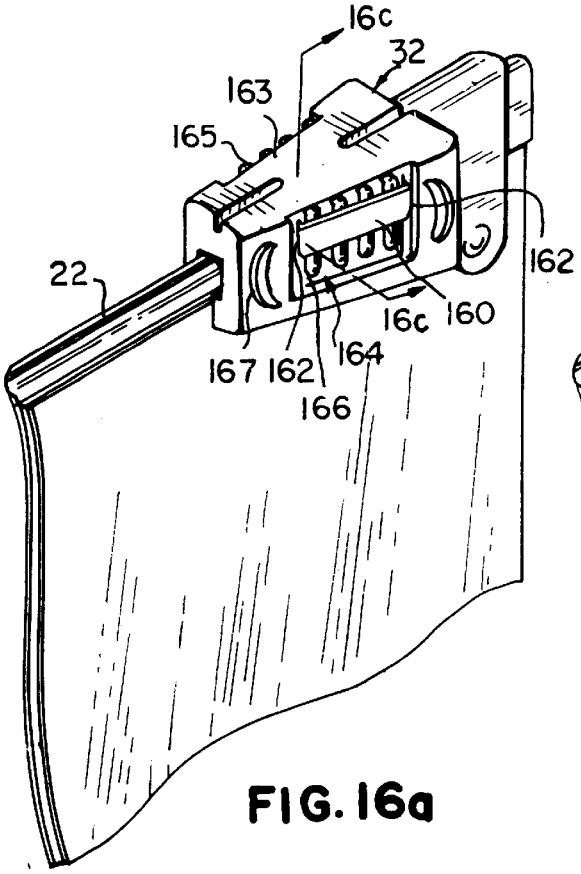
FIG. 16*a* is a partial isometric view of a slider bag having a tamper-evident feature in the form of a U-shaped element extending through slots in the slider in the closed position and dug into the zipper.
Figure 16B:
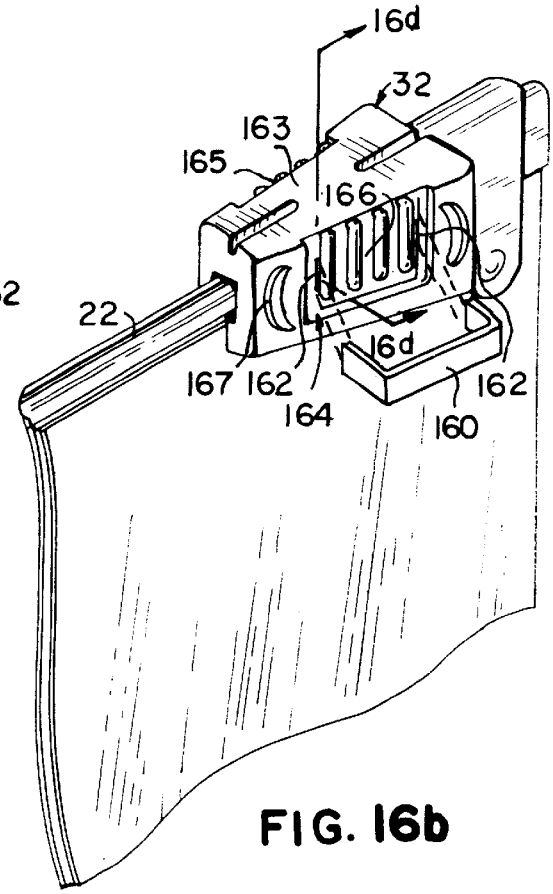
FIG. 16*b* is a partial isometric view of the slider bag showing the U-shaped element in the process of being disengaged from the zipper and removed from the slider
Figure 16C:
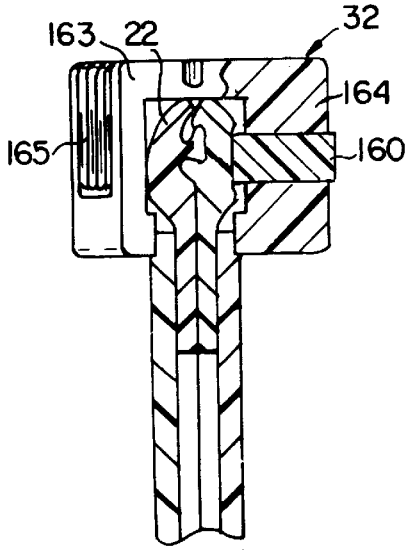
FIG. 16*c* is a sectional view taken generally along line 16*c*—16*c* in FIG 16*a,*
Figure 16D:
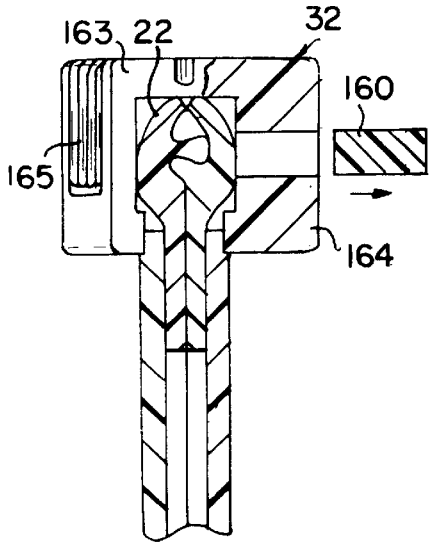
FIG. 16*d* is a sectional view taken generally along line 16*d*—16*d* in FIG. 16*b;*

As shown in FIGS. 15*a–d*, an arrow-shaped latch 150 may alternatively extend from the slider 32 and be engaged to the end stop 34. The latch 150 is inserted into a cavity 152 within the end stop 34 and snappingly engaged to a shoulder 154 within the cavity 152. In response to forcing the slider 32 away from its closed position, the latch 150 is broken away from the slider 32 and remains captured within the cavity 152 as shown in FIGS. 15*b* and 15*d*.

Referring to FIGS. 16*a–d*, there is shown a tamper-evident feature in the form of a U-shaped rigid or semi-rigid retaining element 160 extending through slots 162 in the slider 32 and dug into the zipper 22 (see FIG. 16*c*) when the slider 32 is in the closed position. The U-shaped element 160 may be composed of metal or plastic. The slider 32 includes a transverse member 163 and a pair of side walls 164 and 165 extending downward from opposing longitudinal sides of the transverse member 163. The transverse member 163 rides along the upper portion of the zipper 22. The side wall 164 includes a leg 166 and a hinged wing 167. After the slider 32 is installed on the zipper 22, the wing 167 encompasses and is latched to the leg 166. The side wall 165 includes a leg and a hinged wing akin to the respective leg 166 and wing 167 of the side wall 164. The slots 162 are formed by a small gap separating the wing 167 20 from the leg 166. Further details concerning the construction of the slider 32 may be obtained from U.S. application Ser. No. 08/938,047 filed Apr. 26, 1997, entitled "High-Strength Slider for a Reclosable Bag," and already incorporated herein by reference in its entirety.

An advantage of the tamper-evident feature in FIGS. 16*a–d* is that a slider bag utilizing the slider 32 constructed as described above is already suitable for receiving the U-shaped element 160. No special features need to be added to the slider 32. Therefore, such a slider bag may be retrofitted with the U-shaped element 160 to provide the bag with a degree of tamper evidence. To allow the slider 32 to be moved away from the closed position, the U-shaped element 160 is disengaged from the zipper 22 and removed from the slider 32. To facilitate such removal of the U-shaped element, a prying tool such as a screwdriver may be inserted between the slider leg 166 and the U-shaped element 160. In an alternative embodiment, the U-shaped element 160 is replaced with a rigid element that passes through only a single slot or hole in the slider 32 and digs into the zipper 22. This rigid element is preferably provided with some sort of handle that can be manipulated by hand or with a tool to facilitate removal of the rigid element from the slider 32.

In another set of embodiments illustrated in FIGS. 17*a–c* through FIGS. 20*a–b*, the tamper-evident feature initially maintains a mouth portion of the plastic bag in a folded position and allows the mouth portion to be unfolded in response to removing or breaking the tamper-evident feature. The tamper-evident feature can be employed with both slider and sliderless bags.

Figure 17A:
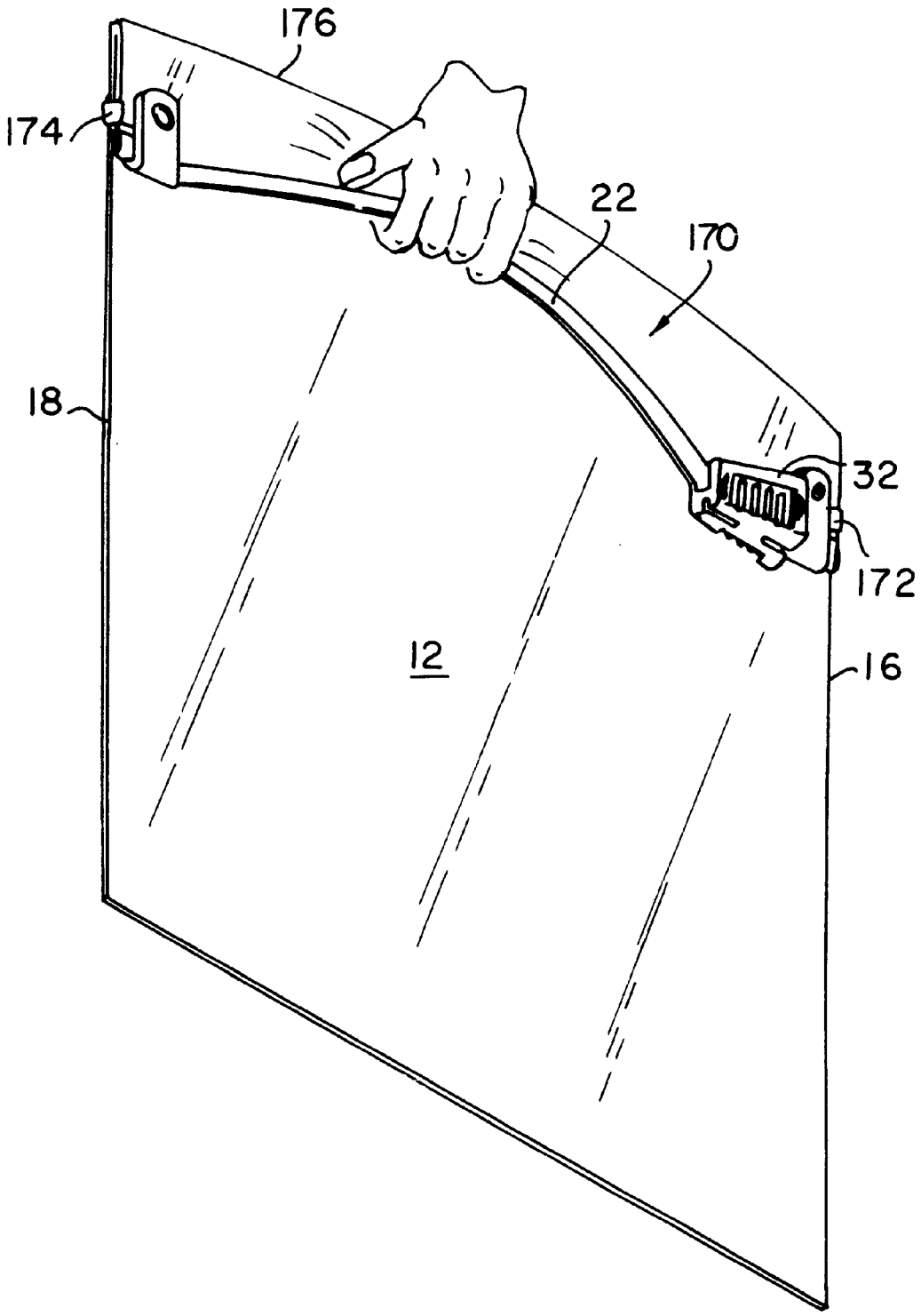
FIG. 17*a* is an isometric view of a slider bag having a tamper-evident feature created by folding over the mouth portion of the bag and detachably connecting the folded-over mouth portion to the sides of the bag.
Figure 17B:
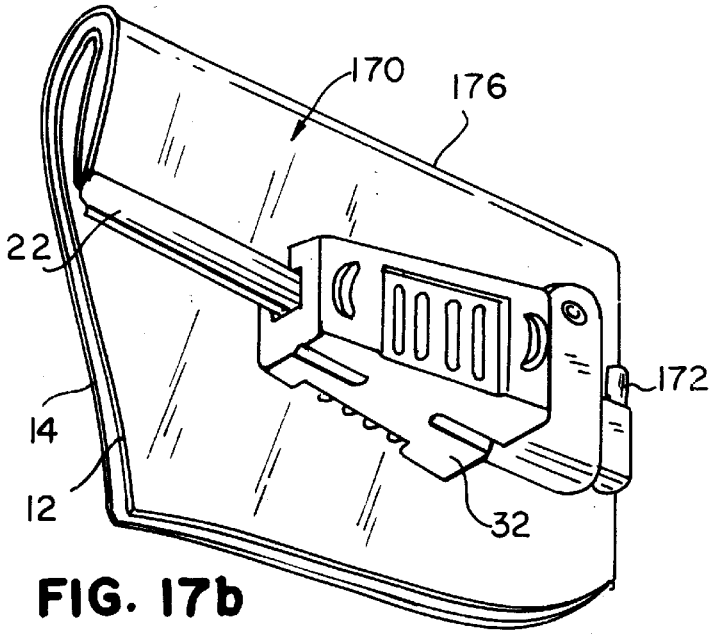
FIG. 17*b* is a partial isometric view of the slider bag showing one of the side seals attaching the folded-over mouth portion to the sides of the bag.
Figure 17C:
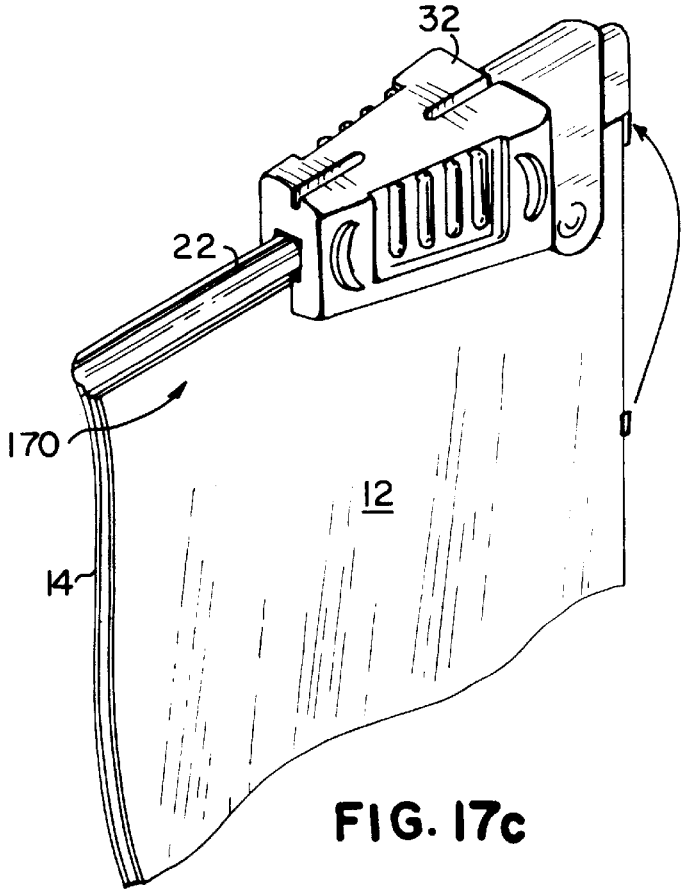
FIG. 17*c* is a partial isometric view of the slider bag after the side seals have been broken to allow the mouth portion to be unfolded.

Referring to FIGS. 17*a–c*. there is shown a tamper-evident feature created by folding over the mouth portion 170 of the bag and detachably sealing the folded-over mouth portion 170 to the sides 16 and 18 of the bag along side spot seals 172 and 174. With the bag in the folded position, as shown in FIGS. 17*a* and 17*b*, access to the interior of the bag is restricted because even if the slider 32 is moved from the closed position to the open position, one would have difficulty getting past the fold 176 after entering the bag. In addition to providing tamper evidence, the folded-over mouth portion 170 provides a convenient handle for carrying the bag especially when the seals for attaching the folded-over mouth portion 170 are located along the sides 16 and 18. To gain access to the contents of the bag, the side seals 172 and 174 are ruptured to allow the mouth portion 170 to be unfolded as shown in FIG. 17*c*.

As shown in FIGS. 18, 19*a–b*, and 20*a–b*, the folded-over mouth portion 170 may alternatively be secured in the folded position by other means. For example, in FIG. 18, the folded-over mouth portion 170 is held in the folded position by the combination of a spot seal 174 along the side 18 and a flexible member, such as a price tag pin 180, passing through both the zipper 22 and the adjacent unfolded bag portion near the side 16. The price tag pin 180 performs the dual function of maintaining the mouth portion 170 in the folded position and preventing the slider 32 from being moved away from the closed position until the pin 180 is removed from the bag. The embodiment in FIG. 18 may be modified to eliminate the spot seal 174 and provide either a single price tag pin approximately midway between the sides 16 and 18 or a pair of price tag pins near the respective sides 16 and 18. Any price tag pin near the side 16 is preferably disposed adjacent to or through the slider 32 along the zipper 22 to prevent the slider 32 from being moved away from the closed position until the pin is removed from the bag.

Figure 19A:
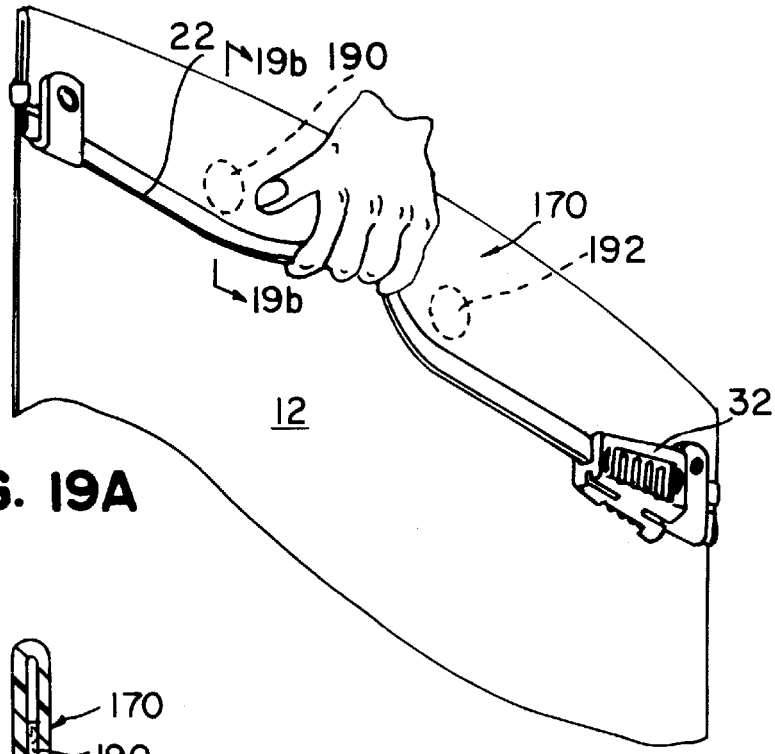
FIG. 19*a* is an isometric view of a slider bag having a tamper-evident feature created by folding over the mouth portion of the bag and detachably sealing the inner panel of the folded-over mouth portion to the adjacent bag panel.
Figure 19B:
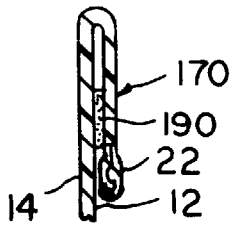
FIG. 19*b* is a section view taken generally along line 19*b*—19*b* in FIG. 19*a;*

In FIGS. 19*a–b*, the folded-over mouth portion 170 is secured in the folded position by one or more spot seals 190 and 192 detachably sealing the bag panel 12 to itself. The spot seals may, for example, be peelable seals or "dirty" seals. The portion of the bag panel 12 on the mouth portion 170 is adhered to the adjacent unfolded portion of the bag panel 12. The spot seals 190 and 192 may, if desired, be strategically positioned to create a handle for carrying the bag.

Figure 20A:
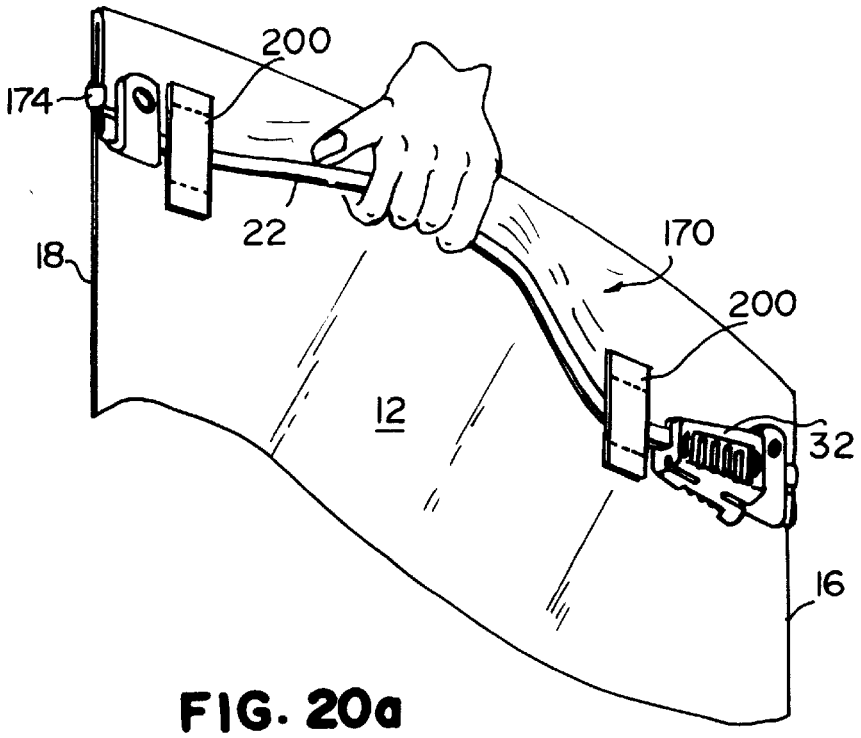
FIG. 20*a* is an isometric view of a slider bag having a tamper-evident feature created by folding over the mouth portion of the bag and securing the folded-over mouth portion with partially removable stickers.
Figure 20B:
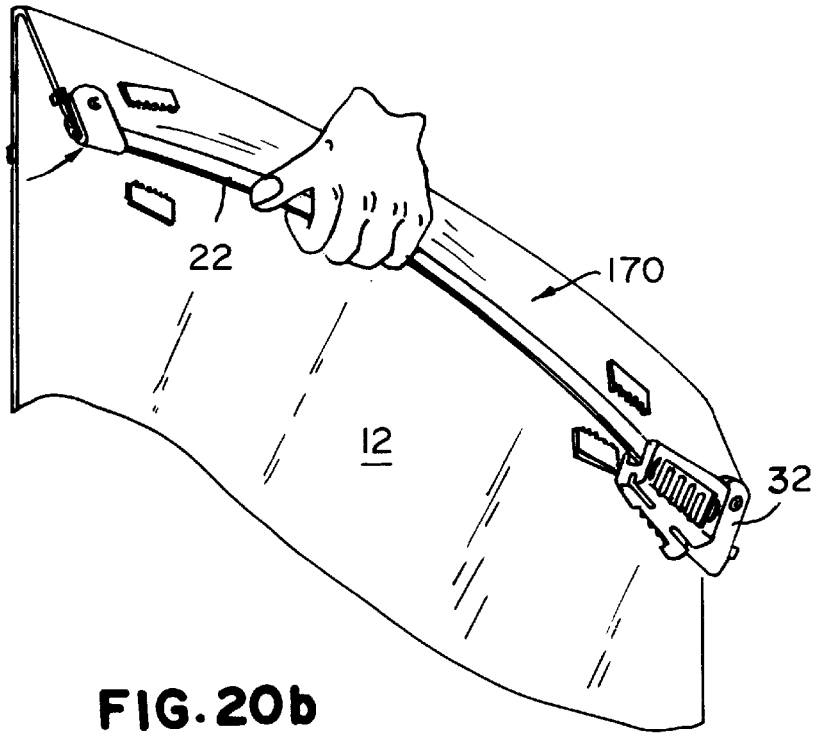
FIG. 20*b* is an isometric view of the slider bag in FIG. 20*a* after the stickers have been partially removed to allow the mouth portion to be unfolded.

In FIGS. 20*a–b*, the folded-over mouth portion 170 is secured in the folded position by one or more partially removable stickers (adhesive strip) or pressure-sensitive labels 200 that attach the mouth portion 170 to the adjacent unfolded portion of the bag panel 12. One of the stickers 200 may be positioned adjacent to or over the slider 32 along the zipper 22 to prevent the slider 32 from being moved away from the closed position until the sticker is removed from the bag. A middle portion of each sticker 200 is torn away to allow the mouth portion 170 to be unfolded, while end portions of each sticker 200 remain permanently attached to the bag to provide evidence of tampering.

Each tamper-evident feature described above makes it difficult to gain access to the interior of the bag prior to removing or breaking the tamper-evident feature. In the absence of graspable upper flanges, the zipper 22 is difficult to grasp and open by hand without the use of the slider 32. Therefore, with respect to those tamper-evident features that prevent movement of the slider 32 away from the closed position, such tamper-evident features effectively inhibit tampering with the contents of the bag to a degree that is especially useful for non-food and some food applications, where tamper-proof packaging is not required but tamper-resistant packaging is nonetheless desirable. For example, the tamper-evident features in FIGS. 4*a–d*, 8*a–d*, 9*a–d*, 10*a–d*, 11*a–d*, and 12*a–d* are advantageous in that tamper resistance is accomplished by using a removable cardboard, paper, plastic, or foil member covering or adjacent to the slider in the closed position and adhered, stapled, friction fit, or connected in some other way to the bag to hold the member in place. If the member is composed of plastic, the plastic may be a polymer or copolymer comprised of polyethylene-based polymers, polystyrene, polypropylene, nylon, polycarbonate, or other similar materials. The polyethylene-based polymers may include low density polyethylene, linear low density polyethylene, metallocene, ethylene vinyl acetate, or other similar materials. The shrink wrap 80 in FIGS. 8*a–d* is preferably composed of conventional low density polyethylene. The plastic tab 120 in FIGS. 12*a–d* is formed from the same material as the bag body panels 12 and 14 because the detachable tab panels 120*a* and 120*b* are integrally formed with the respective bag body panels 12 and 14.

Further, the tamper-evident features in FIGS. 5*a–d* and 6*a–d* are advantageous in that tamper resistance is accomplished by using a conventional price tag pin anchored to at least the zipper 22 (FIGS. 5*a–d* and 6*a–d*) and optionally anchored to the slider 32 as well (FIGS. 5*a–d*) so as to obstruct movement of the slider 32 away from its closed position. The tamper-evident features in FIGS. 13*a–d*, 14*a–d*, and 15*a–d* are advantageous in that tamper resistance is accomplished by using a movable (FIGS. 13*a–d*) or breakable (FIGS. 14*a–d* and 15*a–d*) latch releasably coupling the slider 32 to the end stop 34. The stepped element in FIGS. 7*a–h* is likewise effective at providing resistance to tampering with the contents of the slider bag.

Figure 18:
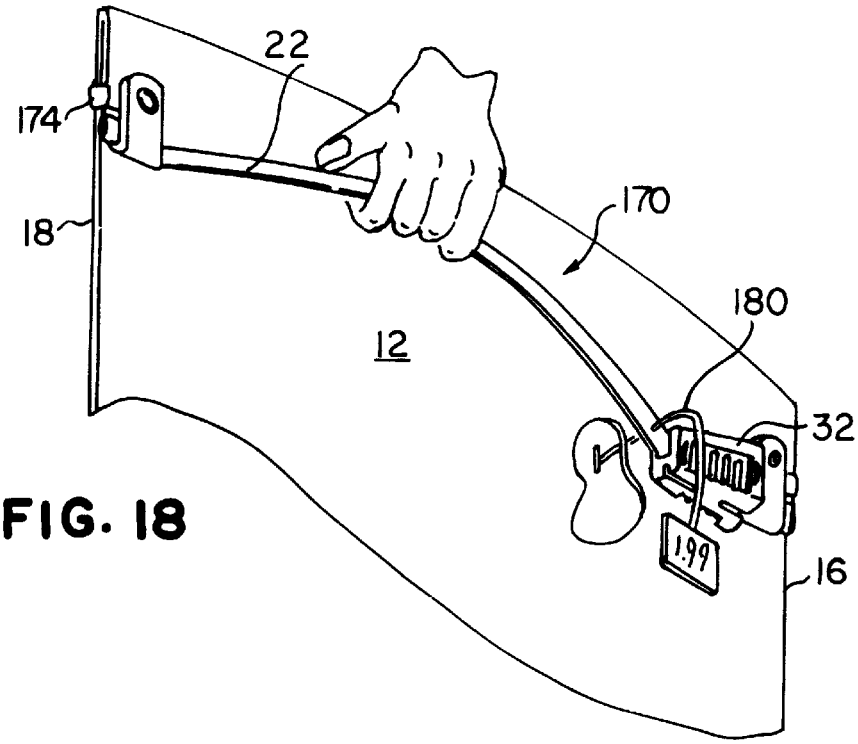
FIG. 18 is an isometric view of a slider bag having a tamper-evident feature created by folding over the mouth portion of the bag and securing the folded-over mouth portion with a price tag pin and a side seal.

Unlike the tamper-evident features in FIGS. 4*a–d* through 16*a–d*, the tamper-evident features in FIGS. 17*a–c*, 18, 19*a–b*, and 20*a–b* do not rely upon preventing movement of the slider 32 away from its closed position. Rather, the tamper-evident features in FIGS. 17*a–c*, 18, 19*a–b*, and 20*a–b* rely upon securing the bag mouth in a folded position and would still be effective in the absence of the slider 32 and the zipper 22. Therefore, unlike the other tamper-evident features, the tamper-evident features in FIGS. 17*a–c*, 18, 19*a–b*, and 20*a–b* may be applied to virtually any type of bag. If, however, a slider bag is employed, it is contemplated that the tamper-evident features of FIGS. 4*a–d* through 16*a–d* can be combined with the tamper-evident features in FIGS. 17*a–c*, 18, 19*a–b*, and 20*a–b* so as to both secure the bag mouth in a folded position and prevent movement of the slider away from its closed position until the appropriate tamper-evident feature is broken or removed. Examples of bags combining multiple tamper-evident features is illustrated in FIGS. 18 and 20*a–b*.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A slider bag, comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other a slider slidably mounted to said zipper for movement between a closed position and an open position, said rib and groove profiles being interlocked while said slider is in said closed position, said rib and groove profiles being progressively disengaged in response to movement of said slider to said open position; and a member initially encapsulating said slider when said slider is in said closed position so as to initially obstruct the movement of said slider away from said closed position and coupled to said opposing body panels below said zipper, said member is a shrink wrap, said member having a length substantially less than a length of said zipper, said member being removable from the bag, said slider being allowed to move away from said closed position in response to removal of said member from the bag.

2. The bag of claim 1, wherein said member comprises a polymer.

3. The bag of claim 1, wherein said member comprises a polyethylene-based polymer, polystyrene, polypropylene, nylon, or polycarbonate.

4. The bag of claim 3, wherein said polyethylene-based polymer includes a low density polyethylene, a linear low density polyethylene, metallocene, or an ethylene vinyl acetate.

5. The bag of claim 1, wherein said member is made from a low density polyethylene.

6. The bag of claim 1, wherein said member is adapted to be removed by tearing or peeling from the bag.

7. The bag of claim 1, wherein said member is notched or perforated.

8. The bag of claim 1, wherein said member has a first portion and a second portion, said first portion of said member remains attached to at least one of said opposing body panels upon removal of said second portion of said member from the bag.

9. The bag of claim 1, wherein said member further includes an end termination mounted to said zipper and disposed adjacent to said closed position of said slider, said end termination stopping said slider at said closed position when said slider is moved from said open position to said closed position and wherein said member further encapsulates said end termination.

10. The bag of claim 1, wherein said shrink wrap is adhered to or thermally fused to said opposing body panels.

11. The bag of claim 1, wherein said shrink wrap is made from a low density polyethylene.

12. A slider bag comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other;

a slider slidably mounted to said zipper for movement between a closed position and an open position, said rib and groove profiles being interlocked while said slider is in said closed position, said rib and groove profiles being progressively disengaged in response to movement of said slider to said open position; and a removable member initially extending over said zipper in front of said slider so as to initially obstruct the movement of said slider away from said closed position, said member having a length substantially less than a length of said zipper, said member is a shrink wrap, said member being notched or perforated, said member has a first portion and a second portion, said first portion of said member remains attached to at least one of said opposing body panels upon removal of said second portion of said member from said bag, said slider being allowed to move away from said closed position in response to removal of said member from said bag.

13. The bag of claim 12, wherein said member comprises a polymer.

14. The bag of claim 12, wherein said member comprises a polyethylene-based polymer, polystyrene, polypropylene, nylon, or polycarbonate.

15. A slider bag, comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other;

a slider slidably mounted to said zipper for movement between a closed position and an open position, said rib and groove profiles being interlocked while said slider is in said closed position, said rib and groove profiles being progressively disengaged in response to movement of said slider to said open position; and a removable member initially extending over said zipper in front of said slider so as to initially obstruct the movement of said slider away from said closed position, said member having a length substantially less than a length of said zipper, said member being a shrink wrap, said slider being allowed to move away from said closed position in response to removal of said member from said bag.

16. The bag of claim 15, wherein said member comprises a polyethylene-based polymer, polystyrene, polypropylene, nylon, or polycarbonate.

17. The bag of claim 16, wherein said polyethylene-based polymer includes a low density polyethylene, a linear low density polyethylene, metallocene, or an ethylene vinyl acetate.

18. The bag of claim 15, wherein said member is adapted to be removed by tearing or peeling from said bag.

19. The bag of claim 15, wherein said shrink wrap is adhered to or thermally fused to said opposing body panels.

20. The bag of claim 15, wherein said shrink wrap is made from a low density polyethylene.

21. The bag of claim 15, wherein said member is notched or perforated.

22. A slider bag, comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other;

a slider slidably mounted to said zipper for movement between a closed position and an open position, said rib and groove profiles being interlocked while said slider is in said closed position, said rib and groove profiles being progressively disengaged in response to movement of said slider to said open position; and a removable plastic shrink wrap initially encapsulating said slider when said slider is in said closed position so as to initially obstruct the movement of said slider away from said closed position and coupled to said opposing body panels below said zipper, said shrink wrap comprises a polyethylene-based polymer, polystyrene, polypropylene, nylon, or polycarbonate, said shrink wrap having a length substantially less than a length of said zipper, said slider being allowed to move away from said closed position in response to removal of said shrink wrap from said bag.

23. The bag of claim 22, wherein said polyethylene-based polymer includes a low density polyethylene, a linear low density polyethylene, metallocene, or an ethylene vinyl acetate.

24. The bag of claim 22, wherein said shrink wrap is made from a low density polyethylene.

25. The bag of claim 22, wherein said shrink wrap is adapted to be removed by tearing or peeling from said bag.

26. The bag of claim 22, wherein said shrink wrap is notched or perforated.

27. The bag of claim 22, wherein a portion of said shrink wrap remains attached to at least one of said opposing body panels upon removal of said shrink wrap.

28. The bag of claim 22, wherein said shrink wrap further includes an end termination mounted to said zipper and disposed adjacent to said closed position of said slider, said end termination stopping said slider at said closed position when said slider is moved from said open position to said closed position and wherein said shrink wrap further encapsulates said end termination.

29. The bag of claim 22, wherein said shrink wrap is adhered to or thermally fused to said opposing body panels.

30. A slider bag, comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other;

a slider slidably mounted to said zipper for movement between a closed position and an open position, said rib and groove profiles being interlocked while said slider is in said closed position, said rib and groove profiles being progressively disengaged in response to movement of said slider to said open position; and a removable plastic shrink wrap initially encapsulating said slider when said slider is in said closed position so as to initially obstruct the movement of said slider away from said closed position and coupled to said opposing body panels below said zipper, said shrink wrap comprises a polyethylene-based polymer, polystyrene, polypropylene, nylon, or polycarbonate, said slider being allowed to move away from said closed position in response to removal of said shrink wrap from said bag.

31. A slider bag, comprising:

first and second opposing body panels fixedly connected to each other along a pair of sides and a bottom bridging said pair of sides;

a reclosable zipper extending along a mouth formed opposite said bottom and including a rib profile and a groove profile, said rib profile and said groove profile adapted to interlock with each other;

a slider slidably mounted to said zipper for movement between a closed position and an open position, said rib and groove profiles being interlocked while said slider is in said closed position, said rib and groove profiles being progressively disengaged in response to movement of said slider to said open position; and a removable shrink wrap initially encapsulating said slider when said slider is in said closed position so as to initially obstruct the movement of said slider away from said closed position and coupled to said opposing body panels below said zipper, said shrink wrap having a length substantially less than a length of said zipper, said slider being allowed to move away from said closed position in response to removal of said shrink wrap from said bag.

* * * * *